US010959035B2

(12) United States Patent
Butera, III et al.

(10) Patent No.: US 10,959,035 B2
(45) Date of Patent: Mar. 23, 2021

(54) SYSTEM, METHOD, AND APPARATUS FOR GENERATING AND DIGITALLY PROCESSING A HEAD RELATED AUDIO TRANSFER FUNCTION

(71) Applicant: Bongiovi Acoustics LLC, Port St. Lucie, FL (US)

(72) Inventors: Joseph G. Butera, III, Stuart, FL (US); Mark J. Harpster, Port St. Lucie, FL (US); Ryan J. Copt, Port St. Lucie, FL (US); Litang Gu, Shenzhen (CN)

(73) Assignee: BONGIOVI ACOUSTICS LLC, Port St. Lucie, FL (US)

( * ) Notice: Subject to any disclaimer, the term of this patent is extended or adjusted under 35 U.S.C. 154(b) by 0 days.

(21) Appl. No.: 16/530,736

(22) Filed: Aug. 2, 2019

(65) Prior Publication Data

US 2020/0053503 A1 Feb. 13, 2020

Related U.S. Application Data

(60) Provisional application No. 62/721,914, filed on Aug. 23, 2018, provisional application No. 62/713,798, filed on Aug. 2, 2018.

(51) Int. Cl.
*H04S 7/00* (2006.01)
*H04R 5/04* (2006.01)
(Continued)

(52) U.S. Cl.
CPC ..... *H04S 7/303* (2013.01); *H04R 5/02* (2013.01); *H04R 5/04* (2013.01); *H04S 1/007* (2013.01);
(Continued)

(58) Field of Classification Search
CPC . H04R 5/033; H04S 2420/01; H04S 2400/11; H04S 2400/01; H04S 7/304; H04S 5/005; H04S 7/302; H04S 7/303
(Continued)

(56) References Cited

U.S. PATENT DOCUMENTS 2,643,729 A 6/1953 McCracken
3,430,007 A 2/1969 Thielen
(Continued)

FOREIGN PATENT DOCUMENTS

BR 9611417 2/1999
BR 96113723 7/1999
(Continued)

OTHER PUBLICATIONS

NovaSound Int., http://www.novasoundint.com/new_page_t.htm, 2004.
(Continued)

*Primary Examiner* — Alexander Krzystan
(74) *Attorney, Agent, or Firm* — Malloy & Malloy, P.L.

(57) ABSTRACT

The present invention provides for an apparatus, system, and method for generating a head related audio transfer function in real time. Specifically, the present invention utilizes unique structural components including a tragus structure and an antihelix structure in connection with a microphone in order to communicate the location of a sound in three dimensional space to a user. The invention also utilizes an audio processor to digitally process the head related audio transfer function. The system may also be utilized to pan the directionality of audio sources within a virtual environment at least partially in response to movement of a user.

2 Claims, 13 Drawing Sheets

(51) Int. Cl.
*H04R 5/02* (2006.01)
*H04S 1/00* (2006.01)
*H04S 5/00* (2006.01)

(52) U.S. Cl.
CPC ..... *H04S 5/00* (2013.01); *H04S 2400/13* (2013.01); *H04S 2420/01* (2013.01)

(58) Field of Classification Search
USPC ..... 381/310, 306, 307, 309
See application file for complete search history.

(56) References Cited

U.S. PATENT DOCUMENTS 3,795,876 A 3/1974 Takashi et al.
3,813,687 A 5/1974 Geil
4,162,462 A 7/1979 Endoh et al.
4,184,047 A 1/1980 Langford
4,218,950 A 8/1980 Uetrecht
4,226,533 A 10/1980 Snowman
4,257,325 A 3/1981 Bertagni
4,353,035 A 10/1982 Schröder
4,356,558 A 10/1982 Owen et al.
4,363,007 A 12/1982 Haramoto et al.
4,392,027 A 7/1983 Bock
4,399,474 A 8/1983 Coleman, Jr.
4,412,100 A 10/1983 Orban
4,458,362 A 7/1984 Berkovitz et al.
4,489,280 A 12/1984 Bennett, Jr. et al.
4,517,415 A 5/1985 Laurence
4,538,297 A 8/1985 Waller
4,549,289 A 10/1985 Schwartz et al.
4,584,700 A 4/1986 Scholz
4,602,381 A 7/1986 Cugnini et al.
4,612,665 A 9/1986 Inami et al.
4,641,361 A 2/1987 Rosback
4,677,645 A 6/1987 Kaniwa et al.
4,696,044 A 9/1987 Waller, Jr.
4,701,953 A 10/1987 White
4,704,726 A 11/1987 Gibson
4,715,559 A 12/1987 Fuller
4,739,514 A 4/1988 Short et al.
4,815,142 A 3/1989 Imreh
4,856,068 A 8/1989 Quatieri, Jr. et al.
4,887,299 A 12/1989 Cummins et al.
4,997,058 A 3/1991 Bertagni
5,007,707 A 4/1991 Bertagni
5,073,936 A 12/1991 Gurike et al.
5,133,015 A 7/1992 Scholz
5,195,141 A 3/1993 Jang
5,210,704 A 5/1993 Husseiny
5,210,806 A 5/1993 Kihara et al.
5,355,417 A 10/1994 Burdisso et al.
5,361,381 A 11/1994 Short
5,384,856 A 1/1995 Kyouno et al.
5,420,929 A 5/1995 Geddes et al.
5,425,107 A 6/1995 Bertagni et al.
5,463,695 A 10/1995 Werrbach
5,465,421 A 11/1995 McCormick et al.
5,467,775 A 11/1995 Callahan et al.
5,473,214 A 12/1995 Hildebrand
5,511,129 A 4/1996 Craven et al.
5,515,444 A 5/1996 Burdisso et al.
5,539,835 A 7/1996 Bertagni et al.
5,541,866 A 7/1996 Sato et al.
5,572,443 A 11/1996 Emoto et al.
5,615,275 A 3/1997 Bertagni
5,617,480 A 4/1997 Ballard et al.
5,638,456 A 6/1997 Conley et al.
5,640,685 A 6/1997 Komoda
5,671,287 A 9/1997 Gerzon
5,693,917 A 12/1997 Bertagni et al.
5,699,438 A 12/1997 Smith et al.
5,727,074 A 3/1998 Hildebrand
5,737,432 A 4/1998 Werrbach
5,812,684 A 9/1998 Mark
5,828,768 A 10/1998 Eatwell et al.
5,832,097 A 11/1998 Armstrong et al.
5,838,805 A 11/1998 Warnaka et al.
5,848,164 A 12/1998 Levine
5,861,686 A 1/1999 Lee
5,862,461 A 1/1999 Yoshizawa et al.
5,872,852 A 2/1999 Dougherty
5,901,231 A 5/1999 Parrella et al.
5,990,955 A 11/1999 Koz
6,058,196 A 5/2000 Heron
6,078,670 A 6/2000 Beyer
6,093,144 A 7/2000 Jaeger et al.
6,108,431 A 8/2000 Bachler
6,195,438 B1 2/2001 Yumoto et al.
6,201,873 B1 3/2001 Dal Farra
6,202,601 B1 3/2001 Ouellette et al.
6,208,237 B1 3/2001 Saiki et al.
6,244,376 B1 6/2001 Granzotto
6,263,354 B1 7/2001 Gandhi
6,285,767 B1 9/2001 Klayman
6,292,511 B1 9/2001 Goldston et al.
6,317,117 B1 11/2001 Goff
6,318,797 B1 11/2001 Böhm et al.
6,332,029 B1 12/2001 Azima et al.
6,343,127 B1 1/2002 Billoud
6,518,852 B1 2/2003 Derrick
6,529,611 B2 3/2003 Kobayashi et al.
6,535,846 B1 3/2003 Shashoua
6,570,993 B1 5/2003 Fukuyama
6,587,564 B1 7/2003 Cusson
6,618,487 B1 9/2003 Azima et al.
6,661,897 B2 12/2003 Smith
6,661,900 B1 12/2003 Allred et al.
6,760,451 B1 7/2004 Craven et al.
6,772,114 B1 8/2004 Sluijter et al.
6,839,438 B1 1/2005 Riegelsberger et al.
6,847,258 B2 1/2005 Ishida et al.
6,871,525 B2 3/2005 Withnall et al.
6,907,391 B2 6/2005 Bellora et al.
6,999,826 B1 2/2006 Zhou et al.
7,006,653 B2 2/2006 Guenther
7,016,746 B2 3/2006 Wiser et al.
7,024,001 B1 4/2006 Nakada
7,058,463 B1 6/2006 Ruha et al.
7,123,728 B2 10/2006 King et al.
7,236,602 B2 6/2007 Gustavsson
7,254,243 B2 8/2007 Bongiovi
7,266,205 B2 9/2007 Miller
7,269,234 B2 9/2007 Klingenbrunn et al.
7,274,795 B2 9/2007 Bongiovi
7,519,189 B2 4/2009 Bongiovi
7,577,263 B2 8/2009 Tourwe
7,613,314 B2 11/2009 Camp, Jr.
7,676,048 B2 3/2010 Tsutsui
7,711,129 B2 5/2010 Lindahl
7,711,442 B2 5/2010 Ryle et al.
7,747,447 B2 6/2010 Christensen et al.
7,764,802 B2 7/2010 Oliver
7,778,718 B2 8/2010 Janke et al.
7,916,876 B1 3/2011 Helsloot
8,068,621 B2 11/2011 Okabayashi et al.
8,144,902 B2 3/2012 Johnston
8,160,274 B2 4/2012 Bongiovi
8,175,287 B2 5/2012 Ueno et al.
8,218,789 B2 7/2012 Bharitkar et al.
8,229,136 B2 7/2012 Bongiovi
8,284,955 B2 10/2012 Bongiovi et al.
8,385,864 B2 2/2013 Dickson et al.
8,462,963 B2 6/2013 Bongiovi
8,472,642 B2 6/2013 Bongiovi
8,503,701 B2 8/2013 Miles et al.
8,565,449 B2 10/2013 Bongiovi
8,577,676 B2 11/2013 Muesch
8,619,998 B2 12/2013 Walsh et al.
8,705,765 B2 4/2014 Bongiovi
8,750,538 B2 6/2014 Avendano et al.
8,811,630 B2 8/2014 Burlingame
8,879,743 B1 11/2014 Mitra
9,195,433 B2 11/2015 Bongiovi et al.

(56) References Cited

U.S. PATENT DOCUMENTS 9,264,004 B2 2/2016 Bongiovi et al.
9,276,542 B2 3/2016 Bongiovi et al.
9,281,794 B1 3/2016 Bongiovi et al.
9,344,828 B2 5/2016 Bongiovi et al.
9,348,904 B2 5/2016 Bongiovi et al.
9,350,309 B2 5/2016 Bongiovi et al.
9,397,629 B2 7/2016 Bongiovi et al.
9,398,394 B2 7/2016 Bongiovi et al.
9,413,321 B2 8/2016 Bongiovi et al.
9,564,146 B2 2/2017 Bongiovi et al.
9,615,189 B2 4/2017 Copt et al.
9,621,994 B1 4/2017 Bongiovi et al.
9,638,672 B2 5/2017 Butera, III et al.
9,741,355 B2 8/2017 Bongiovi et al.
9,793,872 B2 10/2017 Bongiovi et al.
9,883,318 B2 1/2018 Bongiovi et al.
9,906,858 B2 2/2018 Bongiovi et al.
9,906,867 B2 2/2018 Bongiovi et al.
9,998,832 B2 6/2018 Bongiovi et al.
10,069,471 B2 9/2018 Bongiovi et al.
10,158,337 B2 12/2018 Bongiovi et al.
10,666,216 B2 5/2020 Bongiovi et al.
10,701,505 B2 6/2020 Copt et al.
2001/0008535 A1 7/2001 Lanigan
2001/0043704 A1 11/2001 Schwartz
2001/0046304 A1 11/2001 Rast
2002/0057808 A1 5/2002 Goldstein
2002/0071481 A1 6/2002 Goodings
2002/0094096 A1 7/2002 Paritsky et al.
2003/0016838 A1 1/2003 Paritsky et al.
2003/0023429 A1 1/2003 Claesson et al.
2003/0035555 A1 2/2003 King et al.
2003/0043940 A1 3/2003 Janky et al.
2003/0112088 A1 6/2003 Bizjak
2003/0138117 A1 7/2003 Goff
2003/0142841 A1 7/2003 Wiegand
2003/0164546 A1 9/2003 Giger
2003/0179891 A1 9/2003 Rabinowitz et al.
2003/0216907 A1 11/2003 Thomas
2004/0003805 A1 1/2004 Ono et al.
2004/0005063 A1 1/2004 Klayman
2004/0008851 A1 1/2004 Hagiwara
2004/0022400 A1 2/2004 Magrath
2004/0042625 A1 3/2004 Brown
2004/0044804 A1 3/2004 Mac Farlane
2004/0086144 A1 5/2004 Kallen
2004/0103588 A1 6/2004 Allaei
2004/0138769 A1 7/2004 Akiho
2004/0146170 A1 7/2004 Zint
2004/0189264 A1 9/2004 Matsuura et al.
2004/0208646 A1 10/2004 Choudhary et al.
2005/0013453 A1 1/2005 Cheung
2005/0090295 A1 4/2005 Ali et al.
2005/0117771 A1 6/2005 Vosburgh et al.
2005/0129248 A1 6/2005 Kraemer et al.
2005/0175185 A1 8/2005 Korner
2005/0201572 A1 9/2005 Lindahl et al.
2005/0249272 A1 11/2005 Kirkeby et al.
2005/0254564 A1 11/2005 Tsutsui
2006/0034467 A1 2/2006 Sleboda et al.
2006/0045294 A1 3/2006 Smyth
2006/0064301 A1 3/2006 Aguilar et al.
2006/0098827 A1 5/2006 Paddock et al.
2006/0115107 A1 6/2006 Vincent et al.
2006/0126851 A1 6/2006 Yuen et al.
2006/0126865 A1 6/2006 Blamey et al.
2006/0138285 A1 6/2006 Oleski et al.
2006/0140319 A1 6/2006 Eldredge et al.
2006/0153281 A1 7/2006 Karlsson
2006/0189841 A1 8/2006 Pluvinage
2006/0291670 A1 12/2006 King et al.
2007/0010132 A1 1/2007 Nelson
2007/0030994 A1 2/2007 Ando et al.
2007/0056376 A1 3/2007 King
2007/0119421 A1 5/2007 Lewis et al.
2007/0150267 A1 6/2007 Honma et al.
2007/0173990 A1 7/2007 Smith et al.
2007/0177459 A1 8/2007 Behn
2007/0206643 A1 9/2007 Egan
2007/0223713 A1 9/2007 Gunness
2007/0223717 A1 9/2007 Boersma
2007/0253577 A1 11/2007 Yen et al.
2008/0031462 A1 2/2008 Walsh et al.
2008/0040116 A1 2/2008 Cronin
2008/0049948 A1 2/2008 Christoph
2008/0069385 A1 3/2008 Revit
2008/0123870 A1 5/2008 Stark
2008/0123873 A1 5/2008 Bjorn-Josefsen et al.
2008/0165989 A1 7/2008 Seil et al.
2008/0181424 A1 7/2008 Schulein et al.
2008/0212798 A1 9/2008 Zartarian
2008/0255855 A1 10/2008 Lee et al.
2009/0022328 A1 1/2009 Neugebauer et al.
2009/0054109 A1 2/2009 Hunt
2009/0080675 A1 3/2009 Smirnov et al.
2009/0086996 A1 4/2009 Bongiovi et al.
2009/0116652 A1 5/2009 Kirkeby et al.
2009/0282810 A1 11/2009 Leone et al.
2009/0290725 A1 11/2009 Huang
2009/0296959 A1 12/2009 Bongiovi
2010/0045374 A1 2/2010 Wu et al.
2010/0246832 A1 9/2010 Villemoes et al.
2010/0256843 A1 10/2010 Bergstein et al.
2010/0278364 A1 11/2010 Berg
2010/0303278 A1 12/2010 Sahyoun
2011/0002467 A1 1/2011 Nielsen
2011/0013736 A1 1/2011 Tsukamoto et al.
2011/0065408 A1 3/2011 Kenington et al.
2011/0087346 A1 4/2011 Larsen et al.
2011/0096936 A1 4/2011 Gass
2011/0194712 A1 8/2011 Potard
2011/0230137 A1 9/2011 Hicks et al.
2011/0257833 A1 10/2011 Trush et al.
2011/0280411 A1 11/2011 Cheah et al.
2012/0008798 A1 1/2012 Ong
2012/0014553 A1 1/2012 Bonanno
2012/0020502 A1* 1/2012 Adams ..... H04S 7/304
381/310
2012/0022842 A1* 1/2012 Amadu ..... H04S 7/30
703/6
2012/0063611 A1 3/2012 Kimura
2012/0099741 A1 4/2012 Gotoh et al.
2012/0170759 A1 7/2012 Yuen et al.
2012/0170795 A1 7/2012 Sancisi et al.
2012/0189131 A1 7/2012 Ueno et al.
2012/0213034 A1 8/2012 Imran
2012/0213375 A1 8/2012 Mahabub et al.
2012/0300949 A1 11/2012 Rauhala
2012/0302920 A1 11/2012 Bridger et al.
2013/0083958 A1 4/2013 Katz et al.
2013/0129106 A1 5/2013 Sapiejewski
2013/0162908 A1 6/2013 Son et al.
2013/0163767 A1 6/2013 Gauger, Jr. et al.
2013/0163783 A1 6/2013 Burlingame
2013/0169779 A1 7/2013 Pedersen
2013/0220274 A1 8/2013 Deshpande et al.
2013/0227631 A1 8/2013 Sharma et al.
2013/0242191 A1 9/2013 Leyendecker
2013/0251175 A1 9/2013 Bongiovi et al.
2013/0288596 A1 10/2013 Suzuki et al.
2013/0338504 A1 12/2013 Demos et al.
2013/0343564 A1 12/2013 Darlington
2014/0067236 A1 3/2014 Henry et al.
2014/0119583 A1 5/2014 Valentine et al.
2014/0126734 A1 5/2014 Gauger, Jr. et al.
2014/0261301 A1 9/2014 Leone
2014/0379355 A1 12/2014 Hosokawsa
2015/0039250 A1 2/2015 Rank
2015/0194158 A1 7/2015 Oh et al.
2015/0208163 A1 7/2015 Hallberg et al.
2015/0215720 A1 7/2015 Carroll
2016/0209831 A1 7/2016 Pal
2017/0072305 A1* 3/2017 Watanabe ..... G06F 3/017
2017/0188989 A1 7/2017 Copt et al.

(56) References Cited

U.S. PATENT DOCUMENTS

| | | | | |
|---|---|---|---|---|
| 2017/0193980 | A1 | 7/2017 | Bongiovi et al. | |
| 2017/0272887 | A1 | 9/2017 | Copt et al. | |
| 2017/0345408 | A1 | 11/2017 | Hong et al. | |
| 2018/0091109 | A1 | 3/2018 | Bongiovi et al. | |
| 2018/0102133 | A1 | 4/2018 | Bongiovi et al. | |
| 2018/0139565 | A1 | 5/2018 | Norris et al. | |
| 2019/0020950 | A1 | 1/2019 | Bongiovi et al. | |
| 2019/0069114 | A1* | 2/2019 | Tai | H04S 7/304 |
| 2019/0318719 | A1 | 10/2019 | Copt et al. | |
| 2019/0387340 | A1* | 12/2019 | Audfray | H04S 7/304 |
| 2020/0007983 | A1 | 1/2020 | Bongiovi et al. | |
| 2020/0053503 | A1* | 2/2020 | Butera, III | H04S 1/007 |
| 2020/0404441 | A1 | 12/2020 | Copt, et al. | |

FOREIGN PATENT DOCUMENTS

| | | | |
|---|---|---|---|
| CA | 2533221 | | 6/1995 |
| CA | 2161412 | | 4/2000 |
| CA | 2854086 | | 12/2018 |
| CN | 1139842 | | 1/1997 |
| CN | 1173268 | A | 2/1998 |
| CN | 1221528 | A | 6/1999 |
| CN | 1357136 | A | 7/2002 |
| CN | 1391780 | | 1/2003 |
| CN | 1682567 | | 10/2005 |
| CN | 1879449 | | 12/2006 |
| CN | 1910816 | A | 2/2007 |
| CN | 101163354 | | 4/2008 |
| CN | 101277331 | | 10/2008 |
| CN | 101518083 | | 8/2009 |
| CN | 101536541 | A | 9/2009 |
| CN | 101720557 | | 6/2010 |
| CN | 101946526 | A | 1/2011 |
| CN | 101964189 | | 2/2011 |
| CN | 102171755 | | 8/2011 |
| CN | 102265641 | | 11/2011 |
| CN | 102361506 | | 2/2012 |
| CN | 102652337 | | 8/2012 |
| CN | 102754151 | | 10/2012 |
| CN | 102822891 | | 12/2012 |
| CN | 102855882 | | 1/2013 |
| CN | 103004237 | A | 3/2013 |
| CN | 203057339 | | 7/2013 |
| CN | 103247297 | | 8/2013 |
| CN | 103250209 | | 8/2013 |
| CN | 103262577 | | 8/2013 |
| CN | 103348697 | | 10/2013 |
| CN | 103455824 | | 12/2013 |
| CN | 1672325 | | 9/2015 |
| DE | 19826171 | | 10/1999 |
| DE | 10116166 | | 10/2002 |
| EP | 0206746 | B1 | 8/1992 |
| EP | 0541646 | | 1/1995 |
| EP | 0580579 | | 6/1998 |
| EP | 0698298 | | 2/2000 |
| EP | 0932523 | | 6/2000 |
| EP | 0666012 | | 11/2002 |
| EP | 2509069 | | 10/2012 |
| EP | 2814267 | B1 | 10/2016 |
| ES | 2218599 | | 10/1998 |
| ES | 2249788 | | 10/1998 |
| ES | 2219949 | | 8/1999 |
| GB | 2003707 | A | 3/1979 |
| GB | 2089986 | | 6/1982 |
| GB | 2320393 | | 12/1996 |
| JP | 3150910 | | 6/1991 |
| JP | 7106876 | | 4/1995 |
| JP | 2005500768 | | 1/2005 |
| JP | 2011059714 | | 3/2011 |
| KR | 1020040022442 | | 3/2004 |
| SU | 1319288 | | 6/1987 |
| TW | 401713 | | 8/2000 |
| WO | WO 9219080 | | 10/1992 |
| WO | WO 1993011637 | | 6/1993 |
| WO | WO 9321743 | | 10/1993 |
| WO | WO 9427331 | | 11/1994 |
| WO | WO 9514296 | | 5/1995 |
| WO | WO 9531805 | | 11/1995 |
| WO | WO9535628 | | 12/1995 |
| WO | WO 9535628 | | 12/1995 |
| WO | WO 9601547 | | 1/1996 |
| WO | WO 9611465 | | 4/1996 |
| WO | WO 9708847 | | 3/1997 |
| WO | WO 9709698 | | 3/1997 |
| WO | WO 9709840 | | 3/1997 |
| WO | WO 9709841 | | 3/1997 |
| WO | WO 9709842 | | 3/1997 |
| WO | WO 9709843 | | 3/1997 |
| WO | WO 9709844 | | 3/1997 |
| WO | WO 9709845 | | 3/1997 |
| WO | WO 9709846 | | 3/1997 |
| WO | WO 9709848 | | 3/1997 |
| WO | WO 9709849 | | 3/1997 |
| WO | WO 9709852 | | 3/1997 |
| WO | WO 9709853 | | 3/1997 |
| WO | WO 9709854 | | 3/1997 |
| WO | WO 9709855 | | 3/1997 |
| WO | WO 9709856 | | 3/1997 |
| WO | WO 9709857 | | 3/1997 |
| WO | WO 9709858 | | 3/1997 |
| WO | WO 9709859 | | 3/1997 |
| WO | WO 9709861 | | 3/1997 |
| WO | WO 9709862 | | 3/1997 |
| WO | WO 9717818 | | 5/1997 |
| WO | WO 9717820 | | 5/1997 |
| WO | WO 9813942 | | 4/1998 |
| WO | WO 9816409 | | 4/1998 |
| WO | WO 9828942 | | 7/1998 |
| WO | WO 9831188 | | 7/1998 |
| WO | WO 9834320 | | 8/1998 |
| WO | WO 9839947 | | 9/1998 |
| WO | WO 9842536 | | 10/1998 |
| WO | WO 9843464 | | 10/1998 |
| WO | WO 9852381 | | 11/1998 |
| WO | WO 9852383 | | 11/1998 |
| WO | WO 9853638 | | 11/1998 |
| WO | WO 9902012 | | 1/1999 |
| WO | WO 9908479 | | 2/1999 |
| WO | WO 9911490 | | 3/1999 |
| WO | WO 9912387 | | 3/1999 |
| WO | WO 9913684 | | 3/1999 |
| WO | WO 9921397 | | 4/1999 |
| WO | WO 9935636 | | 7/1999 |
| WO | WO 9935883 | | 7/1999 |
| WO | WO 9937121 | | 7/1999 |
| WO | WO 9938155 | | 7/1999 |
| WO | WO 9941939 | | 8/1999 |
| WO | WO 9952322 | | 10/1999 |
| WO | WO 9952324 | | 10/1999 |
| WO | WO 9956497 | | 11/1999 |
| WO | WO 9962294 | | 12/1999 |
| WO | WO 9965274 | | 12/1999 |
| WO | WO 0001264 | | 1/2000 |
| WO | WO 0002417 | | 1/2000 |
| WO | WO 0007408 | | 2/2000 |
| WO | WO 0007409 | | 2/2000 |
| WO | WO 0013464 | | 3/2000 |
| WO | WO 0015003 | | 3/2000 |
| WO | WO 0033612 | | 6/2000 |
| WO | WO 0033613 | | 6/2000 |
| WO | WO 03104924 | | 12/2003 |
| WO | WO 2006020427 | | 2/2006 |
| WO | WO 2007092420 | | 8/2007 |
| WO | WO 2008067454 | | 6/2008 |
| WO | WO 2009070797 | | 6/2009 |
| WO | WO 2009102750 | | 8/2009 |
| WO | WO 2009114746 | | 9/2009 |
| WO | WO2009155057 | | 12/2009 |
| WO | WO 2009155057 | | 12/2009 |
| WO | WO 2010027705 | | 3/2010 |
| WO | WO2010051354 | | 5/2010 |
| WO | WO 2010051354 | | 5/2010 |
| WO | WO2010138311 | | 12/2010 |
| WO | WO 2011081965 | | 7/2011 |

(56) References Cited

FOREIGN PATENT DOCUMENTS

| | | | |
|---|---|---|---|
| WO | WO 2012134399 | | 10/2012 |
| WO | WO2012154823 | | 11/2012 |
| WO | WO 2013055394 | | 4/2013 |
| WO | WO 2013076223 | | 5/2013 |
| WO | WO 2014201103 | | 12/2014 |
| WO | WO 2015061393 | | 4/2015 |
| WO | WO 2015077681 | | 5/2015 |
| WO | WO 2016019263 | | 2/2016 |
| WO | WO 2016022422 | | 2/2016 |
| WO | WO 2016144861 | A1 | 9/2016 |
| WO | WO 2019051075 | | 3/2019 |
| WO | WO2019200119 | | 10/2019 |
| WO | WO 2020028833 | | 2/2020 |
| WO | WO2020132060 | | 6/2020 |

OTHER PUBLICATIONS

Stephan Peus et al. "Natürliche Hören mite künstlichem Kopf", Funkschau—Zeitschrift für elektronische Kommunikation, Dec. 31, 1983, pp. 1-4, XP055451269. Web: https://www.neumann.com/?lang-en&id-hist_microphones&cid=ku80_publications.

* cited by examiner

903

901

| | Origin Angle | | Microphone Location and Corresponding Decibels | | | | | | |
|---|---|---|---|---|---|---|---|---|---|
| Angle Array Index | Y-Axis (degrees) | X-axis (degrees) | CE mid | FL mid | FR mid | SL mid | SR mid | BL mid | BR mid |
| 0 | 0 | 0 | 0 | -10 | -10 | -80 | -80 | -80 | -80 |
| 1 | 45 | 0 | -10 | 0 | -80 | -80 | -80 | -80 | -80 |
| 2 | 90 | 0 | -80 | -10 | -80 | -3 | -80 | -80 | -80 |
| 3 | 135 | 0 | -80 | -80 | -80 | -80 | -80 | -3 | -80 |
| 4 | 180 | 0 | -80 | -80 | -80 | -80 | -80 | -10 | -10 |
| 5 | 225 | 0 | -80 | -80 | -80 | -80 | -80 | -80 | -3 |
| 6 | 270 | 0 | -80 | -80 | -10 | -80 | -3 | -80 | -80 |
| 7 | 315 | 0 | -10 | -80 | 0 | -80 | -80 | -80 | -80 |

9031

9032

FIGURE 13

SYSTEM, METHOD, AND APPARATUS FOR GENERATING AND DIGITALLY PROCESSING A HEAD RELATED AUDIO TRANSFER FUNCTION

CLAIM OF PRIORITY

The present non-provisional patent application claims priority pursuant to 35 U.S.C. Section 119(e), and prior filed, provisional application, namely that having Ser. No. 62/713,793 filed on Aug. 2, 2018, the disclosure of which is incorporated herein by reference, in its entirety. In addition, the present non-provisional patent application also claims priority pursuant to 35 U.S.C. Section 119(e), and prior filed, provisional application, namely that having Ser. No. 62/721,914 filed on Aug. 23, 2018, the disclosure of which is incorporated herein by reference, in its entirety.

FIELD OF THE INVENTION

The present invention relates to a systems, methods, and apparatuses for panning audio in virtual environments at least partially in response to movement of a user.

BACKGROUND OF THE INVENTION

Human beings have just two ears, but can locate sounds in three dimensions, in distance and in direction. This is possible because the brain, the inner ears, and the external ears (pinna) work together to make inferences about the location of a sound. The location of a sound is estimated by taking cues derived from one ear (monoaural cues), as well as by comparing the difference between the cues received in both ears (binaural cues).

Binaural cues relate to the differences of arrival and intensity of the sound between the two ears, which assist with the relative localization of a sound source. Monoaural cues relate to the interaction between the sound source and the human anatomy, in which the original sound is modified by the external ear before it enters the ear canal for processing by the auditory system. The modifications encode the source location relative to the ear location and are known as head-related transfer functions (HRTF).

In other words, HRTFs describe the filtering of a sound source before it is perceived at the left and right ear drums, in order to characterize how a particular ear receives sound from a particular point in space. These modifications may include the shape of the listener's ear, the shape of the listener's head and body, the acoustical characteristics of the space in which the sound is played, and so forth. All these characteristics together influence how a listener can accurately tell what direction a sound is coming from. Thus, a pair of HRTFs accounting for all these characteristics, generated by the two ears, can be used to synthesize a binaural sound and accurately recognize it as originating from a particular point in space.

HRTFs have wide ranging applications, from virtual surround sound in media and gaming, to hearing protection in loud noise environments, and hearing assistance for the hearing impaired. Particularly, in fields hearing protection and hearing assistance, the ability to record and reconstruct a particular user's HRTF presents several challenges as it must occur in real time. In the case of an application for hearing protection in high noise environments, heavy hearing protection hardware must be worn over the ears in the form of bulky headphones, thus, if microphones are placed on the outside of the headphones, the user will hear the outside world but will not receive accurate positional data because the HRTF is not being reconstructed. Similarly, in the case of hearing assistance for the hearing impaired, a microphone is similarly mounted external to the hearing aid, and any hearing aid device that fully blocks a user's ear canal will not accurately reproduce that user's HRTF.

Thus, there is a need for an apparatus and system for reconstructing a user's HRTF in accordance to the user's physical characteristics, in order to accurately relay positional sound information to the user in real time.

SUMMARY OF THE INVENTION

The present invention meets the existing needs described above by providing for an apparatus, system, and method for generating a head related audio transfer function. The present invention also provides for the ability to enhance audio in real-time and tailors the enhancement to the physical characteristics of a user and the acoustic characteristics of the external environment.

Accordingly, in initially broad terms, an apparatus directed to the present invention, also known as an HRTF generator, comprises an external manifold and internal manifold. The external manifold is exposed at least partially to an external environment, while the internal manifold is disposed substantially within an interior of the apparatus and/or a larger device or system housing said apparatus.

The external manifold comprises an antihelix structure, a tragus structure, and an opening. The opening is in direct air flow communication with the outside environment, and is structured to receive acoustic waves. The tragus structure is disposed to partially enclose the opening, such that the tragus structure will partially impede and/or affect the characteristics of the incoming acoustic waves going into the opening. The antihelix structure is disposed to further partially enclose the tragus structure as well as the opening, such that the antihelix structure will partially impede and/or affect the characteristics of the incoming acoustic waves flowing onto the tragus structure and into the opening. The antihelix and tragus structures may comprise semi-domes or any variation of partial-domes comprising a closed side and an open side. In a preferred embodiment, the open side of the antihelix structure and the open side of the tragus structure are disposed in confronting relation to one another.

The opening of the external manifold is connected to and in air flow communication with an opening canal inside the external manifold. The opening canal may be disposed in a substantially perpendicular orientation relative to the desired orientation of the user. The opening canal is in further air flow communication with an auditory canal, which is formed within the internal manifold but also be formed partially in the external manifold.

The internal manifold comprises the auditory canal and a microphone housing. The microphone housing is attached or connected to an end of the auditory canal on the opposite end to its connection with the opening canal. The auditory canal, or at least the portion of the auditory canal, may be disposed in a substantially parallel orientation relative to the desired listening direction of the user. The microphone housing may further comprise a microphone mounted against the end of the auditory canal. The microphone housing may further comprise an air cavity behind the microphone on an end opposite its connection to the auditory canal, which may be sealed with a cap.

In at least one embodiment, the apparatus or HRTF generator may form a part of a larger system. Accordingly, the system may comprise a left HRTF generator, a right HRTF generator, a left preamplifier, a right preamplifier, an audio processor, a left playback module, and a right playback module.

As such, the left HRTF generator may be structured to pick up and filter sounds to the left of a user. Similarly, the right HRTF generator may be structured to pick up and filter sounds to the right of the user. A left preamplifier may be structured and configured to increase the gain of the filtered sound of the left HRTF generator. A right preamplifier may be structured and configured to increase the gain of the filtered sound of the right HRTF generator. The audio processor may be structured and configured to process and enhance the audio signal received from the left and right preamplifiers, and then transmit the respective processed signals to each of the left and right playback modules. The left and right playback modules or transducers are structured and configured to convert the electrical signals into sound to the user, such that the user can then perceive the filtered and enhanced sound from the user's environment, which includes audio data that allows the user to localize the source of the originating sound.

In at least one embodiment, the system of the present invention may comprise a wearable device such as a headset or headphones having the HRTF generator embedded therein. The wearable device may further comprise the preamplifiers, audio processor, and playback modules, as well as other appropriate circuitry and components.

In a further embodiment, a method for generating a head related audio transfer function may be used in accordance with the present invention. As such, external sound is first filtered through an exterior of an HRTF generator which may comprise a tragus structure and an antihelix structure. The filtered sound is then passed to the interior of the HRTF generator, such as through the opening canal and auditory canal described above to create an input sound. The input sound is received at a microphone embedded within the HRTF generator adjacent to and connected to the auditory canal in order to create an input signal. The input signal is amplified with a preamplifier in order to create an amplified signal. The amplified signal is then processed with an audio processor, in order to create a processed signal. Finally, the processed signal is transmitted to the playback module in order to relay audio and/or locational audio data to a user.

In certain embodiments, the audio processor may receive the amplified signal and first filter the amplified signal with a high pass filter. The high pass filter, in at least one embodiment, is configured to remove ultra-low frequency content from the amplified signal resulting in the generation of a high pass signal.

The high pass signal from the high pass filter is then filtered through a first filter module to create a first filtered signal. The first filter module is configured to selectively boost and/or attenuate the gain of select frequency ranges in an audio signal, such as the high pass signal. In at least one embodiment, the first filter module boosts frequencies above a first frequency, and attenuates frequencies below a first frequency.

The first filtered signal from the first filter module is then modulated with a first compressor to create a modulated signal. The first compressor is configured for the dynamic range compression of a signal, such as the first filtered signal. Because the first filtered signal boosted higher frequencies and attenuated lower frequencies, the first compressor may, in at least one embodiment, be configured to trigger and adjust the higher frequency material, while remaining relatively insensitive to lower frequency material.

The modulated signal from the first compressor is then filtered through a second filter module to create a second filtered signal. The second filter module is configured to selectively boost and/or attenuate the gain of select frequency ranges in an audio signal, such as the modulated signal. In at least one embodiment, the second filter module is configured to be of least partially inverse relation relative to the first filter module. For example, if the first filter module boosted content above a first frequency by +X dB and attenuated content below a first frequency by −Y dB, the second filter module may then attenuate the content above the first frequency by −X dB, and boost the content below the first frequency by +Y dB. In other words, the purpose of the second filter module in one embodiment may be to "undo" the gain adjustment that was applied by the first filter module.

The second filtered signal from the second filter module is then processed with a first processing module to create a processed signal. In at least one embodiment, the first processing module may comprise a peak/dip module. In other embodiments, the first processing module may comprise both a peak/dip module and a first gain element. The first gain element may be configured to adjust the gain of the signal, such as the second filtered signal. The peak/dip module may be configured to shape the signal, such as to increase or decrease overshoots or undershoots in the signal.

The processed signal from the first processing module is then split with a band splitter into a low band signal, a mid band signal and a high band signal. In at least one embodiment, each band may comprise the output of a fourth order section, which may be realized as the cascade of second order biquad filters.

The low band signal is modulated with a low band compressor to create a modulated low band signal, and the high band signal is modulated with a high band compressor to create a modulated high band signal. The low band compressor and high band compressor are each configured to dynamically adjust the gain of a signal. Each of the low band compressor and high band compressor may be computationally and/or configured identically as the first compressor.

The modulated low band signal, the mid band signal, and the modulated high band signal are then processed with a second processing module. The second processing module may comprise a summing module configured to combine the signals. The summing module in at least one embodiment may individually alter the gain of each of the modulated low band, mid band, and modulated high band signals. The second processing module may further comprise a second gain element. The second gain element may adjust the gain of the combined signal in order to create a processed signal that is transmitted to the playback module.

In additional embodiments, different signal filter and processing systems may be used to additionally provide head tracking and audio panning within virtual audio spaces. Accordingly, processors may also be used to adjust the level of each HRTF input channel pair according to a predefined table of angles and corresponding decibel outputs. In further embodiments, the system comprises a signal filter bank, preferably a finite impulse response ("FIR") filter bank, a signal processor, preferably an upmixer, and a panning function or algorithm configured to detect and subsequently modify angles corresponding to the motion of a user's head, and is further configured to "pan" audio sources in response thereto. Further, the present invention includes methodology for calibration through HRTF coefficient selections, gain tables, and subjective listening tests to provide maximum flexibility for user experience.

By way of analogy, the present invention operates on the principal of a virtual sphere of speakers rotationally affixed to a user's head. The effect of the virtual sphere is accomplished by the FIR filter bank, and may be effectuated even if the output signal is only directed to left and right speakers or headphones. Each speaker within the virtual sphere is identified by a coordinate system and the volume of each speaker is controlled by an upmixer. If the user rotates her head, the sound coming from each speaker must be translated to maintain the directionality of the sound. In effect, virtually speakers aligned with the original angle of a particular sound are not attenuated (or attenuated the least) while the remaining speakers within the virtual sphere are attenuated according to predetermined amounts.

According to one embodiment, the system may include a one-to-many upmixer for each channel of input signal, which is used to determine the level of output signal sent to each one of the virtual speakers. Each input signal includes information corresponding to an original angle, which determines the initial directionality (without modification by panning) on a virtual sphere of speakers surrounding the user. When a user moves her head, a panning function of the present invention determines an appropriate adjustment of the directionality on the virtual sphere of speakers.

In a preferred embodiment, the output of the one-to-many upmixer is fed to a plurality of FIR filter pairs within the FIR filter bank. The FIR filter pairs are arranged into two virtual speaker hemispheres to form complete spherical coverage. Each FIR filter pair includes a left and right channel input, but the output of the FIR filter pairs are configured in a mid-side orientation, and further configured to create the virtual speaker sphere. A signal may be processed by the upmixer, used for each channel of input to determine the level of signal sent to each filter. Each input contains information on an "origin angle" which determines its original point on the virtual speaker sphere. The final decibel output sent to each FIR filter pair is determined for each angle of input contained in the input. Accordingly, the system also includes an array of predetermined relationships between the angle of the input and decibel outputs relative to the original signal level. The system may then interpolate or select an output to send through the FIR filter pair, allowing for a user to determine the directionality of sound through the differences in level provided by each speaker.

However, it is envisioned that the users may be moving or in different positions while in the virtual speaker space. Accordingly, the system also includes a panning function configured to detect the motion of a user's head and correspondingly modify the origin angle before selecting an output to send through the FIR filter pairs, enabling the translation of origin angles of each signal input to new angles based on panning inputs.

By way of non-limiting example, the systems and methodologies of the present embodiment may find use in connection with virtual environments, such as those experienced with a headset unit and earphones. The present embodiment may be utilized to "pan" the directionality of audio sources within the virtual environment in response to input changes from the user and/or the user's head.

The method described herein may be configured to capture and transmit locational audio data to a user in real time, such that it can be utilized as a hearing aid, or in loud noise environments to filter out loud noises. The present invention may also be utilized to transmit directional audio sources from outside a virtual environment, such that a user may be apprised of sounds and their direction outside of the user's virtual environment.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 13 is an exemplary array of original angles and associated attenuation amounts translating an original angle according to motion of a user.

Like reference numerals refer to like parts throughout the several views of the drawings.

DETAILED DESCRIPTION OF THE EMBODIMENT

As illustrated by the accompanying drawings, the present invention is directed to an apparatus, system, and method for generating a head related audio transfer function for a user. Specifically, some embodiments relate to capturing surrounding sound in the external environment in real time, filtering that sound through unique structures formed on the apparatus in order to generate audio positional data, and then processing that sound to enhance and relay the positional audio data to a user, such that the user can determine the origination of the sound in three dimensional space.

Figure 1:
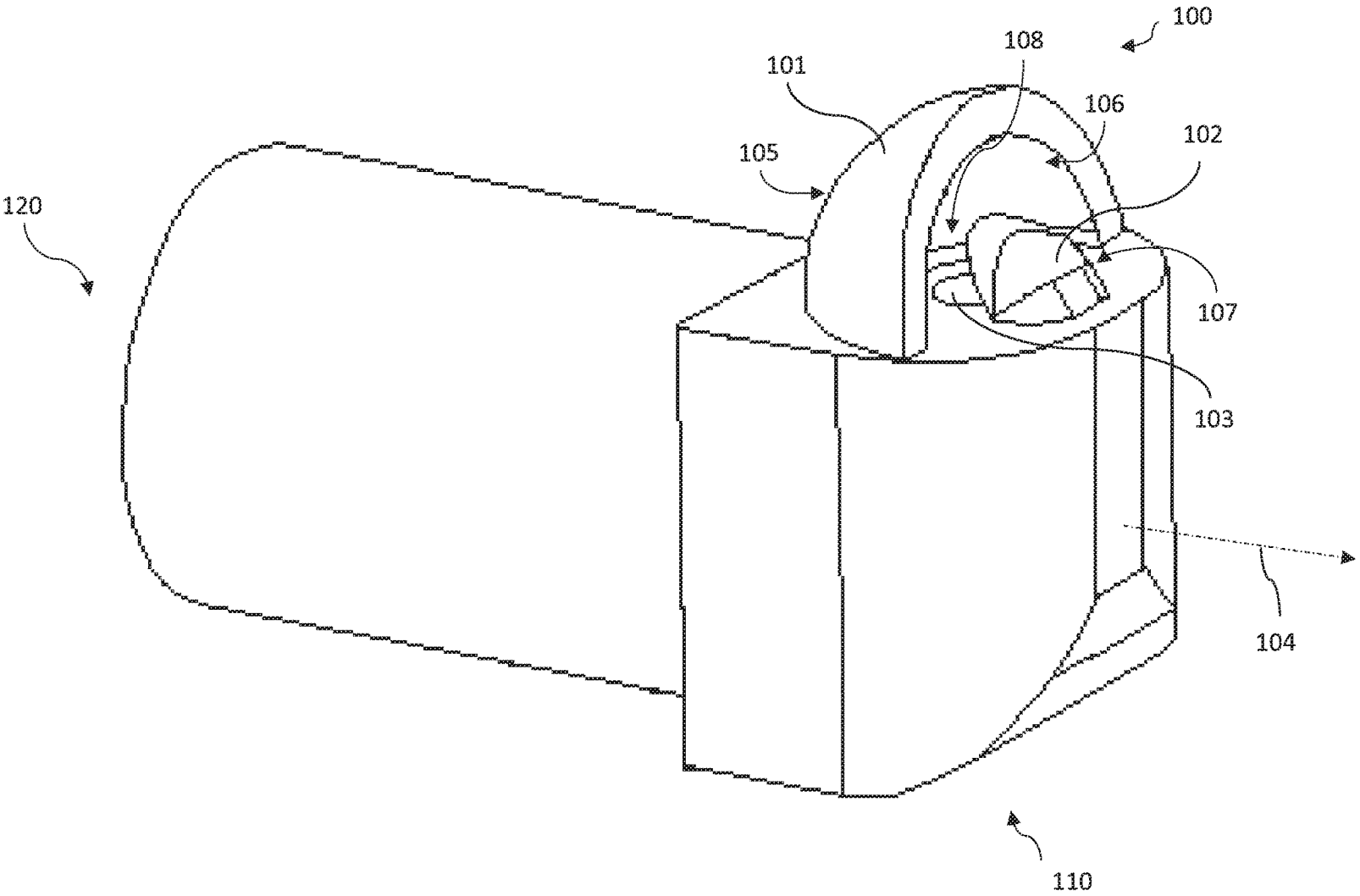
FIG. 1 is a perspective external view of an apparatus for generating a head related audio transfer function.
Figure 2:
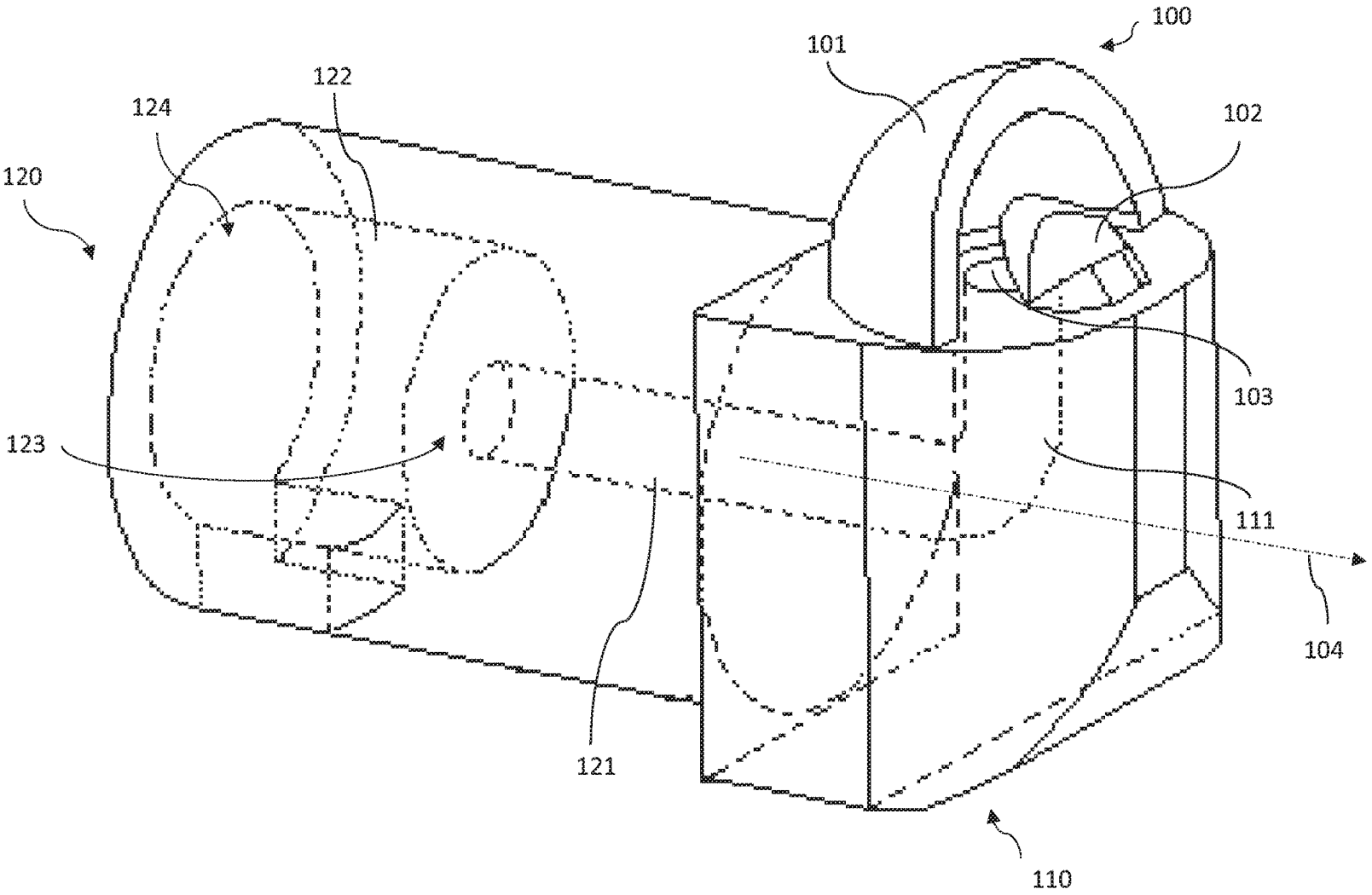
FIG. 2 is a perspective internal view of an apparatus for generating a head related audio transfer function.

As schematically represented, FIGS. 1 and 2 illustrate at least one preferred embodiment of an apparatus 100 for generating a head related audio transfer function for a user, or "HRTF generator". Accordingly, apparatus 100 comprises an external manifold 110 and an internal manifold 120. The external manifold 110 will be disposed at least partially on an exterior of the apparatus 100. The internal manifold 120, on the other hand, will be disposed along an interior of the apparatus 100. For further clarification, the exterior of the apparatus 100 comprises the external environment, such that the exterior is directly exposed to the air of the surrounding environment. The interior of the apparatus 100 comprises at least a partially sealed off environment that partially or fully obstructs the direct flow of acoustic waves.

The external manifold 110 may comprise a hexahedron shape having six faces. In at least one embodiment, the external manifold 110 is substantially cuboid. The external manifold 110 may comprise at least one surface that is concave or convex, such as an exterior surface exposed to the external environment. The internal manifold 120 may comprise a substantially cylindrical shape, which may be at least partially hollow. The external manifold 110 and internal manifold 120 may comprise sound dampening or sound proof materials, such as various foams, plastics, and glass known to those skilled in the art.

Drawing attention to FIG. 1, the external manifold 110 comprises an antihelix structure 101, a tragus structure 102, and an opening 103 that are externally visible. The opening 103 is in direct air flow communication with the surrounding environment, and as such will receive a flow of acoustic waves or vibrations in the air that passes through the opening 103. The tragus structure 102 is disposed to partially enclose the opening 103, and the antihelix structure 101 is disposed to partially enclose both the antihelix structure 102 and the opening 103.

In at least one embodiment, the antihelix structure 101 comprises a semi-dome structure having a closed side 105 and an open side 106. In a preferred embodiment, the open side 106 faces the preferred listening direction 104, and the closed side 105 faces away from the preferred listening direction 104. The tragus structure 102 may also comprise a semi-dome structure having a closed side 107 and an open side 108. In a preferred embodiment, the open side 108 faces away from the preferred listening direction 104, while the closed side 107 faces towards the preferred listening direction 104. In other embodiments, the open side 106 of the antihelix structure 101 may be in direct confronting relation to the open side 108 of the tragus structure 102, regardless of the preferred listening direction 104.

Semi-dome as defined for the purposes of this document may comprise a half-dome structure or any combination of partial-dome structures. For instance, the anti-helix structure 101 of FIG. 1 comprises a half-dome, while the tragus structure 102 comprises a partial-dome wherein the base portion may be less than that of a half-dome, but the top portion may extend to or beyond the halfway point of a half-dome to provide increased coverage or enclosure of the opening 103 and other structures. Of course, in other variations, the top portion and bottom portion of the semi-dome may vary in respective dimensions to form varying portions of a full dome structure, in order to create varying coverage of the opening 103. This allows the apparatus to produce different or enhanced acoustic input for calculating direction and distance of the source sound relative to the user.

In at least one embodiment, the antihelix structure 101 and tragus structure 102 may be modular, such that different sizes or shapes (variations of different semi-domes or partial-domes) may be swapped out based on a user's preference for particular acoustic characteristics.

Drawing attention now to FIG. 2, the opening 103 is connected to, and in air flow communication with, an opening canal 111 inside the external manifold 110. In at least one embodiment, the opening canal 111 is disposed in a substantially perpendicular orientation relative to the desired listening direction 104 of the user. The opening canal 111 is further connected in air flow communication with an auditory canal 121. A portion of the auditory canal 121 may be formed in the external manifold 110. In various embodiments, the opening canal 111 and auditory canal 121 may be of a single piece construction. In other embodiments, a canal connector not shown may be used to connect the two segments. At least a portion of the auditory canal 121 may also be formed within the internal manifold 121.

As previously discussed, the internal manifold 120 is formed wholly or substantially within an interior of the apparatus, such that it is not exposed directly to the outside air and will not be substantially affected by the external environment. In at least one embodiment, the auditory canal 121 formed within at least a portion of the internal manifold 121, will be disposed in a substantially parallel orientation relative to desired listening direction 104 of the user. In a preferred embodiment, the auditory canal comprises a length that is greater than two times its diameter.

A microphone housing 122 is attached to an end of the auditory canal 121. Within the microphone housing 122, a microphone generally at 123, not shown, is mounted against the end of the auditory canal 121. In at least one embodiment, the microphone 123 is mounted flush against the auditory canal 121, such that the connection may be substantially air tight to avoid interference sounds. In a preferred embodiment, an air cavity generally at 124 is created behind the microphone and at the end of the internal manifold 120. This may be accomplished by inserting the microphone 123 into the microphone housing 122, and then sealing the end of the microphone housing, generally at 124, with a cap. The cap may be substantially air tight in at least one embodiment. Different gasses having different acoustic characteristics may be used within the air cavity.

Figure 3:
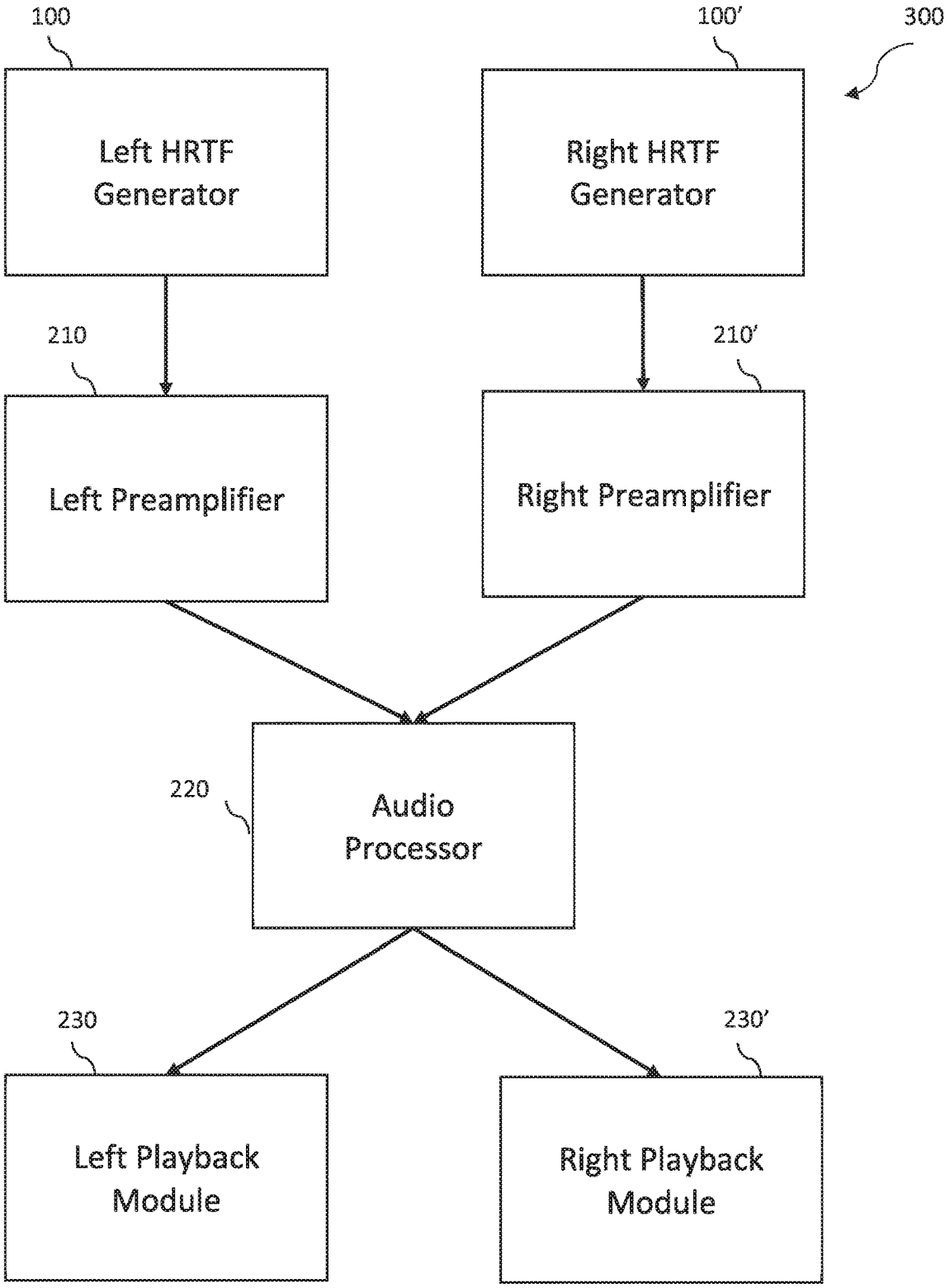
FIG. 3 is a block diagram directed to a system for generating a head related audio transfer function.

In at least one embodiment, apparatus 100 may form a part of a larger system 300 as illustrated in FIG. 3. Accordingly, a system 300 may comprise a left HRTF generator 100, a right HRTF generator 100', a left preamplifier 210, a right preamplifier 210', an audio processor 220, a left playback module 230, and a right playback module 230'.

The left and right HRTF generators 100 and 100' may comprise the apparatus 100 described above, each having unique structures such as the antihelix structure 101 and tragus structure 102. Accordingly, the HRTF generators 100/100' may be structured to generate a head related audio transfer function for a user, such that the sound received by the HRTF generators 100/100' may be relayed to the user to accurately communicate position data of the sound. In other words, the HRTF generators 100/100' may replicate and replace the function of the user's own left and right ears, where the HRTF generators would collect sound, and perform respective spectral transformations or a filtering process to the incoming sounds to enable the process of vertical localization to take place.

A left preamplifier 210 and right preamplifier 210' may then be used to enhance the filtered sound coming from the HRTF generators, in order to enhance certain acoustic characteristics to improve locational accuracy, or to filter out unwanted noise. The preamplifiers 210/210' may comprise an electronic amplifier, such as a voltage amplifier, current amplifier, transconductance amplifier, transresistance amplifier and/or any combination of circuits known to those skilled in the art for increasing or decreasing the gain of a sound or input signal. In at least one embodiment, the preamplifier comprises a microphone preamplifier configured to prepare a microphone signal to be processed by other processing modules. As it may be known in the art, microphone signals sometimes are too weak to be transmitted to other units, such as recording or playback devices with adequate quality. A microphone preamplifier thus increases a microphone signal to the line level by providing stable gain while preventing induced noise that might otherwise distort the signal.

Audio processor 230 may comprise a digital signal processor and amplifier, and may further comprise a volume control. Audio processor 230 may comprise a processor and combination of circuits structured to further enhance the audio quality of the signal coming from the microphone preamplifier, such as but not limited to shelf filters, equalizers, modulators. For example, in at least one embodiment the audio processor 230 may comprise a processor that performs the steps for processing a signal as taught by the present inventor's U.S. Pat. No. 8,160,274, the entire disclosure of which is incorporated herein by reference. Audio processor 230 may incorporate various acoustic profiles customized for a user and/or for an environment, such as those described in the present inventor's U.S. Pat. No. 8,565,449, the entire disclosure of which is incorporated herein by reference. Audio processor 230 may additionally incorporate processing suitable for high noise environments, such as those described in the present inventor's U.S. Pat. No. 8,462,963, the entire disclosure of which is incorporated herein by reference. Parameters of the audio processor 230 may be controlled and modified by a user via any means known to one skilled in the art, such as by a direct interface or a wireless communication interface.

The left playback module 230 and right playback module 230' may comprise headphones, earphones, speakers, or any other transducer known to one skilled in the art. The purpose of the left and right playback modules 230/230' is to convert the electrical audio signal from the audio processor 230 back into perceptible sound for the user. As such, a moving-coil transducer, electrostatic transducer, electret transducer, or other transducer technologies known to one skilled in the art may be utilized.

Figure 4A:
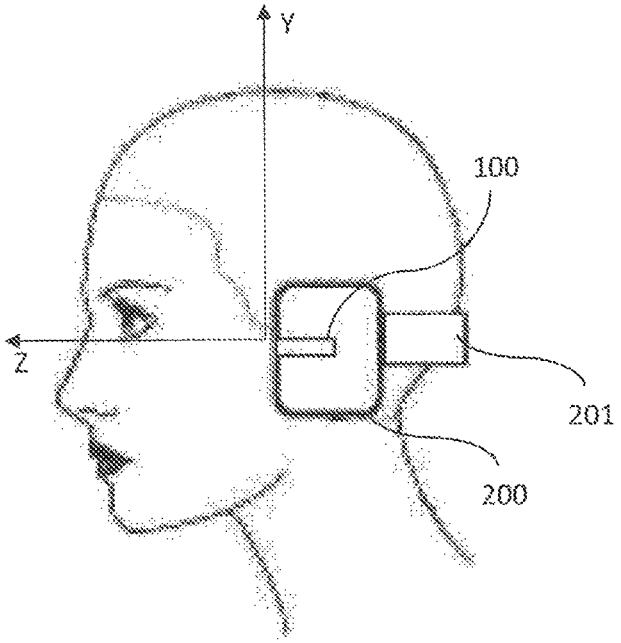
FIG. 4A illustrates a side profile view of a wearable device comprising an apparatus for generating a head related audio transfer function.
Figure 4B:
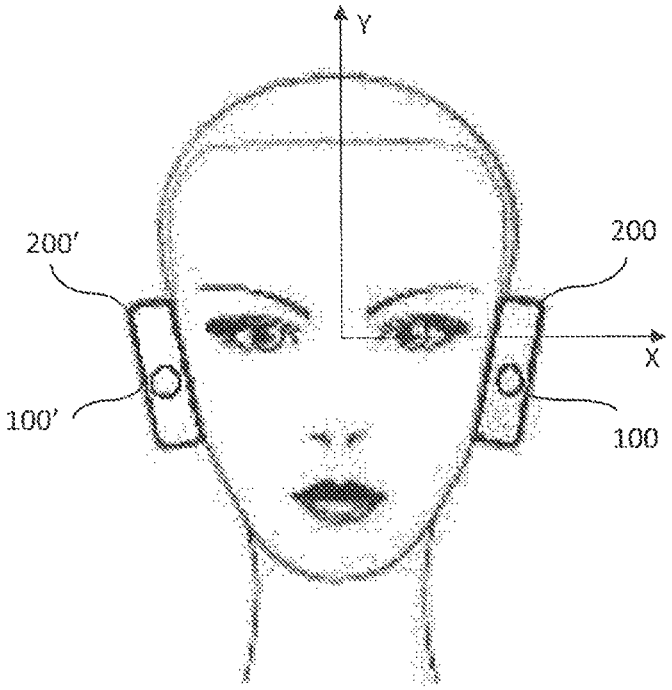
FIG. 4B illustrates a front profile view of a wearable device comprising an apparatus for generating a head related audio transfer function.

In at least one embodiment, the present system 200 comprises a device 200 as generally illustrated at FIGS. 4A and 4B, which may be a wearable headset 200 having the apparatus 100 embedded therein, as well as various amplifiers including but not limited to 210/210', processors such as 220, playback modules such as 230/230', and other appropriate circuits or combinations thereof for receiving, transmitting, enhancing, and reproducing sound.

Figure 5:
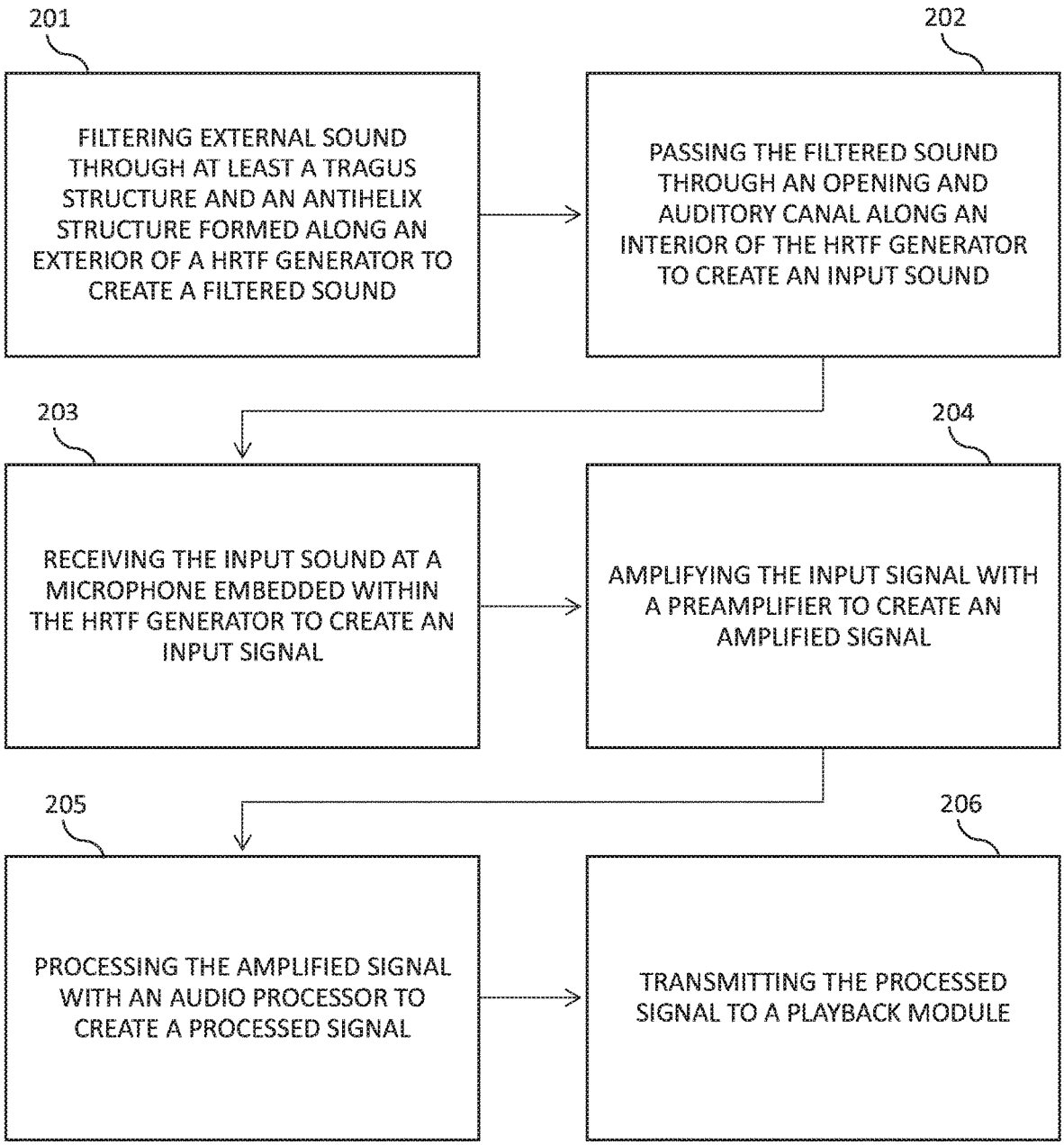
FIG. 5 illustrates a flowchart directed to a method for generating a head related audio transfer function.

In a further embodiment as illustrated in FIG. 5, a method for generating a head related audio transfer function is shown. Accordingly, external sound is first filtered through at least a tragus structure and an antihelix structure formed along an exterior of an HRTF generator, as in 201, in order to create a filtered sound. Next, the filtered sound is passed through an opening and auditory canal along an interior of the HRTF generator, as in 202, in order to create an input sound. The input sound is received at a microphone embedded within the HRTF generator, as in 203, in order to create an input signal. The input signal is then amplified with a preamplifier, as in 204, in order to create an amplified signal. The amplified signal is processed with an audio processor, as in 205, in order to create a processed signal. Finally, the processed signal is transmitted to a playback module, as in 206, in order to relay the audio and/or locational audio data to the user.

In a preferred embodiment of the present invention, the method of FIG. 5 may perform the locational audio capture and transmission to a user in real time. This facilitates usage in a hearing assistance situation, such as a hearing aid for a user with impaired hearing. This also facilitates usage in a high noise environment, such as to filter out noises and/or enhancing human speech.

In at least one embodiment, the method of FIG. 5 may further comprise a calibration process, such that each user can replicate his or her unique HRTF in order to provide for accurate localization of a sound in three dimensional space. The calibration may comprise adjusting the antihelix and tragus structures as described above, which may be formed of modular and/or moveable components. Thus, the antihelix and/or tragus structure may be repositioned, and/or differently shaped and/or sized structures may be used. In further embodiments, the audio processor 230 described above may be further calibrated to adjust the acoustic enhancement of certain sound waves relative to other sound waves and/or signals.

Figure 6:
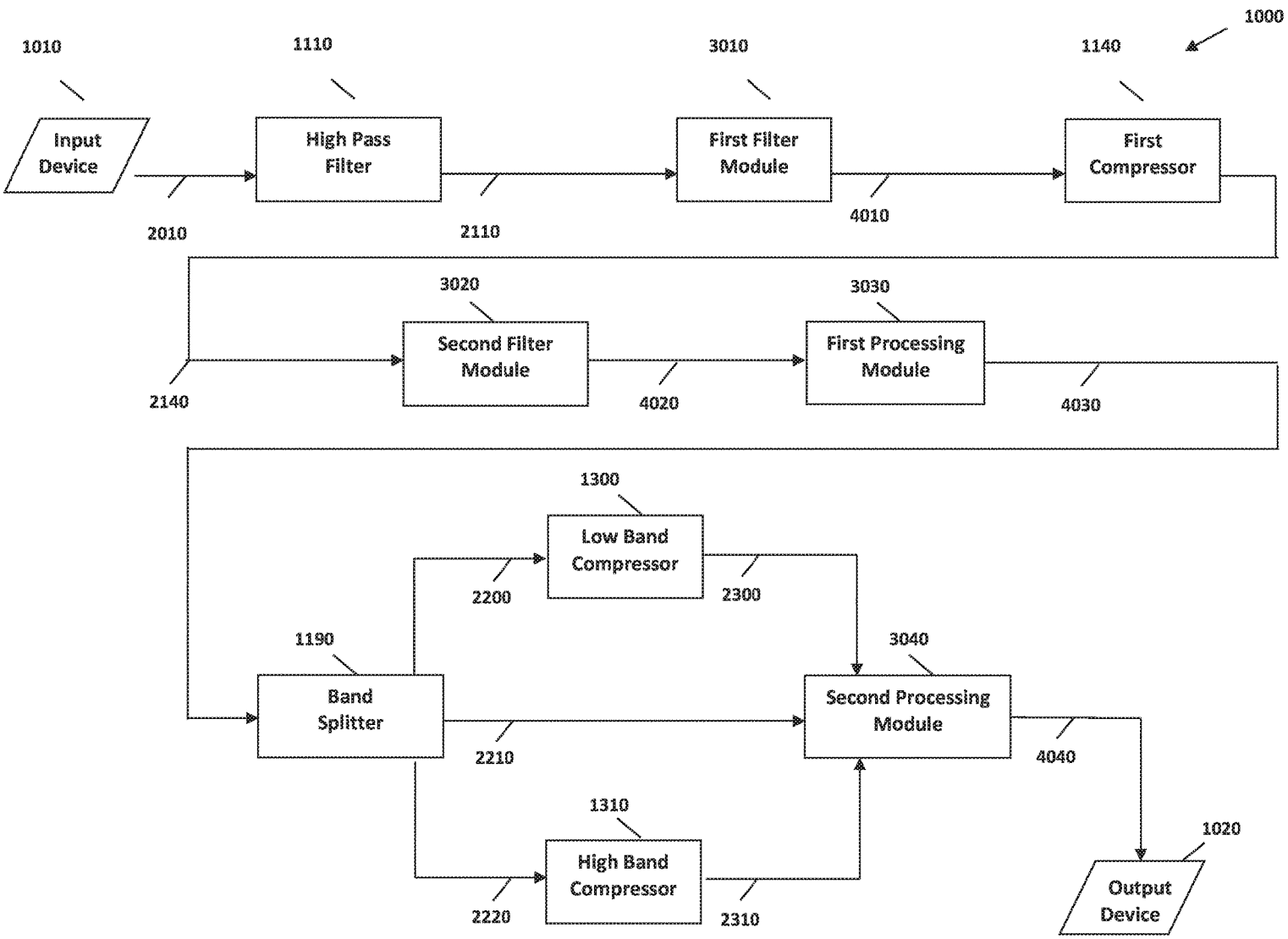
FIG. 6 illustrates a schematic of one embodiment of an audio processor according to one embodiment of the present invention.
Figure 7:
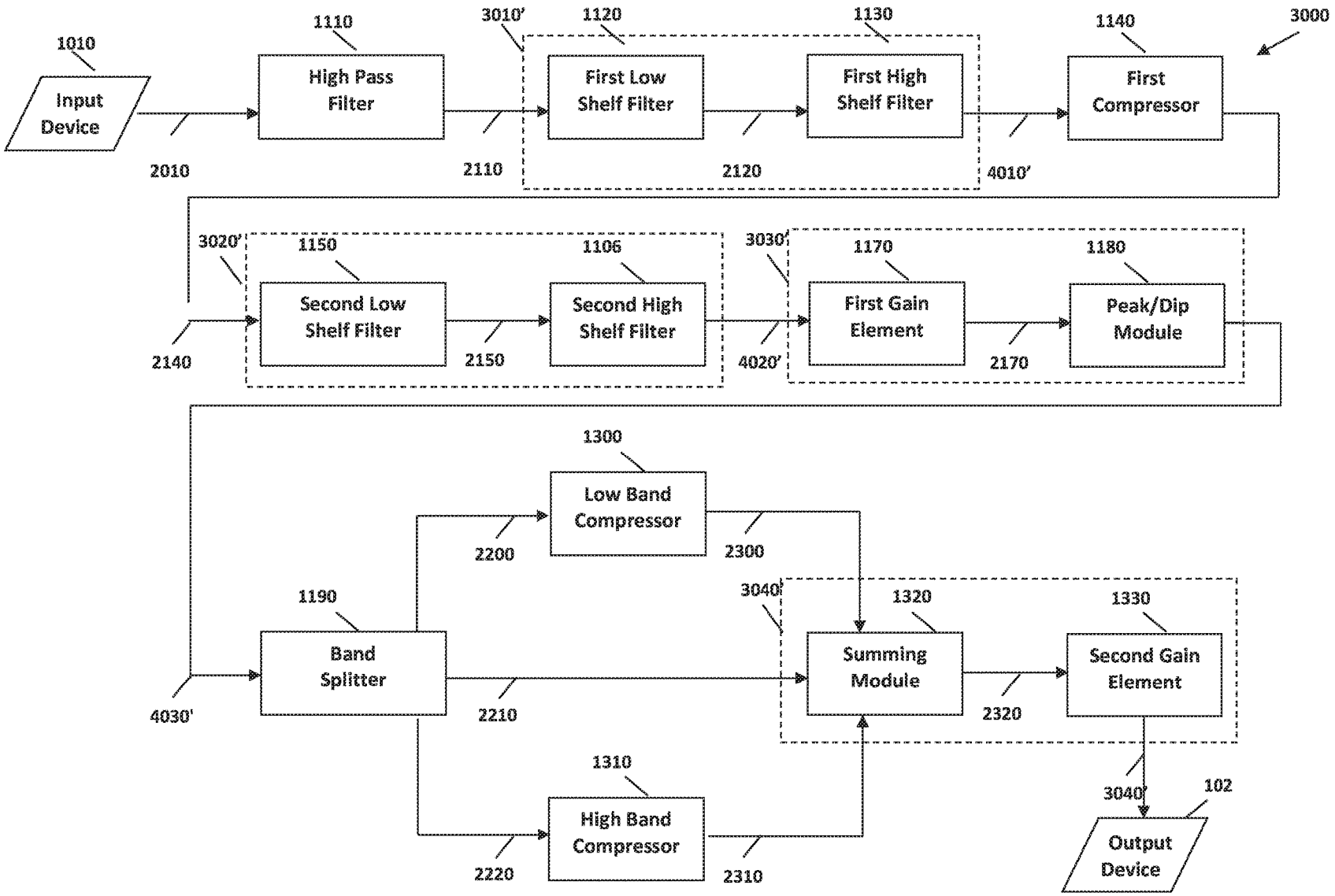
FIG. 7 illustrates a schematic of another embodiment of an audio processor according to one embodiment of the present invention.

With regard to FIG. 6, one embodiment of an audio processor 230 is represented schematically as a system 1000. As schematically represented, FIG. 6 illustrates at least one preferred embodiment of a system 1000, and FIG. 7 provides examples of several subcomponents and combinations of subcomponents of the modules of FIG. 6. Accordingly, and in these embodiments, the systems 1000 and 3000 generally comprise an input device 1010 (such as the left preamplifier 210 and/or right preamplifier 210'), a high pass filter 1110, a first filter module 3010, a first compressor 1140, a second filter module 3020, a first processing module 3030, a band splitter 1190, a low band compressor 1300, a high band compressor 1310, a second processing module 3040, and an output device 1020.

The input device 1010 is at least partially structured or configured to transmit an input audio signal 2010, such as an amplified signal from a left or right preamplifier 210, 210', into the system 1000 of the present invention, and in at least one embodiment into the high pass filter 1110.

The high pass filter 1110 is configured to pass through high frequencies of an audio signal, such as the input signal 2010, while attenuating lower frequencies, based on a predetermined frequency. In other words, the frequencies above the predetermined frequency may be transmitted to the first filter module 3010 in accordance with the present invention. In at least one embodiment, ultra-low frequency content is removed from the input audio signal, where the predetermined frequency may be selected from a range between 300 Hz and 3 kHz. The predetermined frequency however, may vary depending on the source signal, and vary in other embodiments to comprise any frequency selected from the full audible range of frequencies between 20 Hz to 20 kHz. The predetermined frequency may be tunable by a user, or alternatively be statically set. The high pass filter 1110 may further comprise any circuits or combinations thereof structured to pass through high frequencies above a predetermined frequency, and attenuate or filter out the lower frequencies.

The first filter module 3010 is configured to selectively boost or attenuate the gain of select frequency ranges within an audio signal, such as the high pass signal 2110. For example, and in at least one embodiment, frequencies below a first frequency may be adjusted by ±X dB, while frequencies above a first frequency may be adjusted by ±Y dB. In other embodiments, a plurality of frequencies may be used to selectively adjust the gain of various frequency ranges within an audio signal. In at least one embodiment, the first filter module 3010 may be implemented with a first low shelf filter 1120 and a first high shelf filter 1130, as illustrated in FIG. 6. The first low shelf filter 1120 and first high shelf filter 1130 may both be second-order filters. In at least one embodiment, the first low shelf filter 1120 attenuates content below a first frequency, and the first high shelf filter 1120 boosts content above a first frequency. In other embodiments, the frequency used for the first low shelf filter 1120 and first high shelf filter 1130 may comprise two different frequencies. The frequencies may be static or adjustable. Similarly, the gain adjustment (boost or attenuation) may be static or adjustable.

The first compressor 1140 is configured to modulate a signal, such as the first filtered signal 4010. The first compressor 1120 may comprise an automatic gain controller. The first compressor 1120 may comprise standard dynamic range compression controls such as threshold, ratio, attack and release. Threshold allows the first compressor 1120 to reduce the level of the filtered signal 2110 if its amplitude exceeds a certain threshold. Ratio allows the first compressor 1120 to reduce the gain as determined by a ratio. Attack and release determine how quickly the first compressor 1120 acts. The attack phase is the period when the first compressor 1120 is decreasing gain to reach the level that is determined by the threshold. The release phase is the period that the first compressor 1120 is increasing gain to the level determined by the ratio. The first compressor 1120 may also feature soft and hard knees to control the bend in the response curve of the output or modulated signal 2120, and other dynamic range compression controls appropriate for the dynamic compression of an audio signal. The first compressor 1120 may further comprise any device or combination of circuits that is structured and configured for dynamic range compression.

The second filter module 3020 is configured to selectively boost or attenuate the gain of select frequency ranges within an audio signal, such as the modulated signal 2140. In at least one embodiment, the second filter module 3020 is of the same configuration as the first filter module 3010. Specifically, the second filter module 3020 may comprise a second low shelf filter 1150 and a second high shelf filter 1160. In certain embodiments, the second low shelf filter 1150 may be configured to filter signals between 100 Hz and 3000 Hz, with an attenuation of between −5 dB to −20 dB. In certain embodiments the second high shelf filter 1160 may be configured to filter signals between 100 Hz and 3000 Hz, with a boost of between +5 dB to +20 dB.

The second filter module 3020 may be configured in at least a partially inverse configuration to the first filter module 3010. For instance, the second filter module may use the same frequency, for instance the first frequency, as the first filter module. Further, the second filter module may adjust the gain inversely to the gain or attenuation of the first filter module, of content above the first frequency. Similarly second filter module may also adjust the gain inversely to the gain or attenuation of the of the first filter module, of content below the first frequency. In other words, the purpose of the second filter module in one embodiment may be to "undo" the gain adjustment that was applied by the first filter module.

The first processing module 3030 is configured to process a signal, such as the second filtered signal 4020. In at least one embodiment, the first processing module 3030 may comprise a peak/dip module, such as 1180 represented in FIG. 7. In other embodiments, the first processing module 3030 may comprise a first gain element 1170. In various embodiments, the processing module 3030 may comprise both a first gain element 1170 and a peak/dip module 1180 for the processing of a signal. The first gain element 1170, in at least one embodiment, may be configured to adjust the level of a signal by a static amount. The first gain element 1170 may comprise an amplifier or a multiplier circuit. In other embodiments, dynamic gain elements may be used. The peak/dip module 1180 is configured to shape the desired output spectrum, such as to increase or decrease overshoots or undershoots in the signal. In some embodiments, the peak/dip module may further be configured to adjust the slope of a signal, for instance for a gradual scope that gives a smoother response, or alternatively provide for a steeper slope for more sudden sounds. In at least one embodiment, the peak/dip module 1180 comprises a bank of ten cascaded peak/dipping filters. The bank of ten cascaded peaking/dipping filters may further be second-order filters. In at least one embodiment, the peak/dip module 1180 may comprise an equalizer, such as parametric or graphic equalizers.

The band splitter 1190 is configured to split a signal, such as the processed signal 4030. In at least one embodiment, the signal is split into a low band signal 2200, a mid band signal 2210, and a high band signal 2220. Each band may be the output of a fourth order section, which may be further realized as the cascade of second order biquad filters. In other embodiments, the band splitter may comprise any combination of circuits appropriate for splitting a signal into three frequency bands. The low, mid, and high bands may be predetermined ranges, or may be dynamically determined based on the frequency itself, i.e. a signal may be split into three even frequency bands, or by percentage. The different bands may further be defined or configured by a user and/or control mechanism.

A low band compressor 1300 is configured to modulate the low band signal 2200, and a high band compressor 1310 is configured to modulate the high band signal 2220. In at least one embodiment, each of the low band compressor 1300 and high band compressor 1310 may be the same as the first compressor 1140. Accordingly, each of the low band compressor 1300 and high band compressor 1310 may each be configured to modulate a signal. Each of the compressors 1300, 1310 may comprise an automatic gain controller, or any combination of circuits appropriate for the dynamic range compression of an audio signal.

A second processing module 3040 is configured to process at least one signal, such as the modulated low band signal 2300, the mid band signal 2210, and the modulated high band signal 2310. Accordingly, the second processing module 3040 may comprise a summing module 1320 configured to combine a plurality of signals. The summing module 1320 may comprise a mixer structured to combine two or more signals into a composite signal. The summing module 1320 may comprise any circuits or combination thereof structured or configured to combine two or more signals. In at least one embodiment, the summing module 1320 comprises individual gain controls for each of the incoming signals, such as the modulated low band signal 2300, the mid band signal 2210, and the modulated high band signal 2310. In at least one embodiment, the second processing module 3040 may further comprise a second gain element 1330. The second gain element 1330, in at least one embodiment, may be the same as the first gain element 1170. The second gain element 1330 may thus comprise an amplifier or multiplier circuit to adjust the signal, such as the combined signal, by a predetermined amount.

The output device 1020 may comprise the left playback module 230 and/or right playback module 230'.

Figure 8:
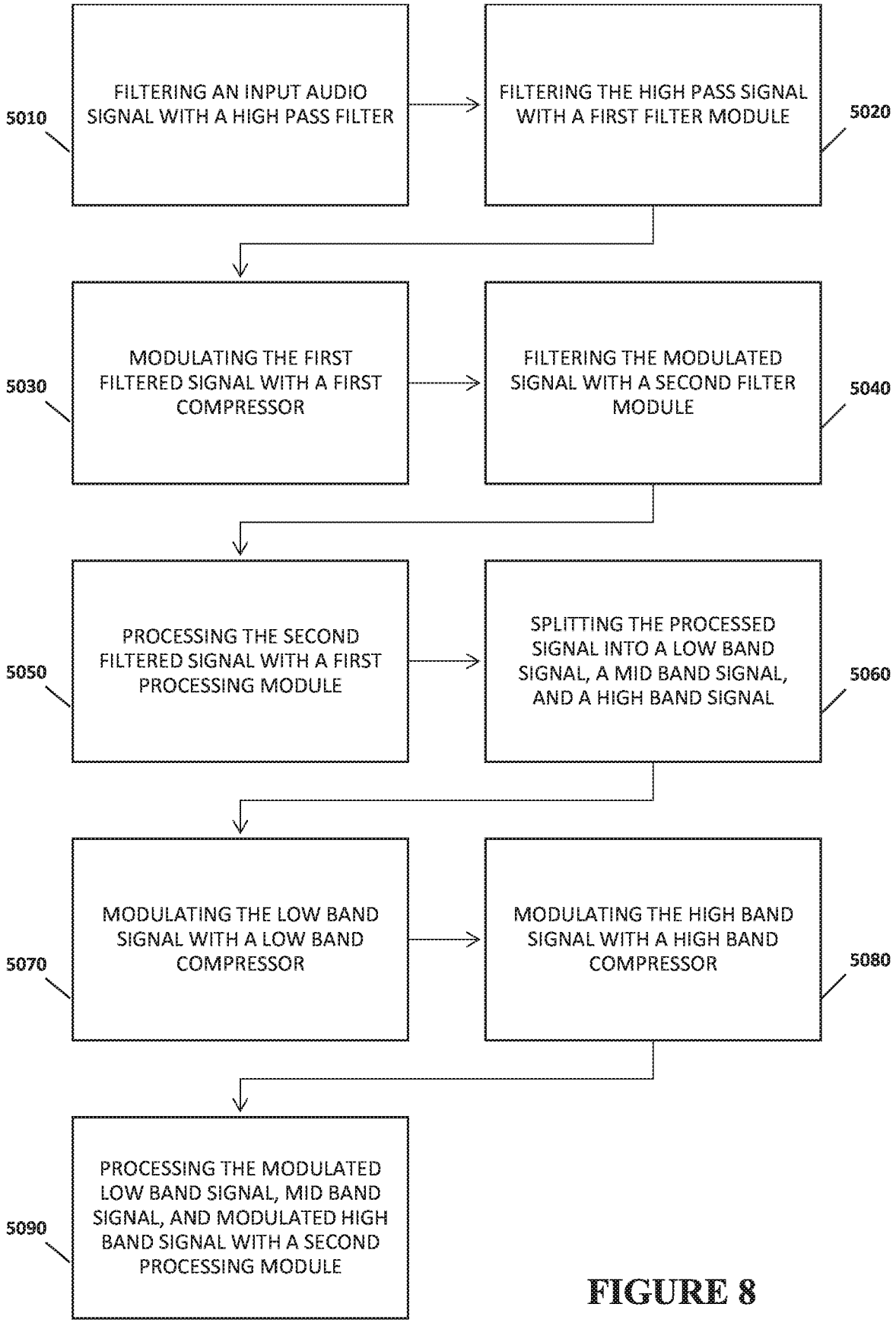
FIG. 8 illustrates a block diagram of one method for processing an audio signal with an audio processor according to one embodiment of the present invention.

As diagrammatically represented, FIG. 8 illustrates a block diagram of one method for processing an audio signal with an audio processor 220, which may in at least one embodiment incorporate the components or combinations thereof from the systems 1000 and/or 3000 referenced above. Each step of the method in FIG. 8 as detailed below may also be in the form of a code segment stored on a non-transitory computer readable medium for execution by the audio processor 220.

Accordingly, an input audio signal, such as the amplified signal, is first filtered, as in 5010, with a high pass filter to create a high pass signal. The high pass filter is configured to pass through high frequencies of a signal, such as the input signal, while attenuating lower frequencies. In at least one embodiment, ultra-low frequency content is removed by the high-pass filter. In at least one embodiment, the high pass filter may comprise a fourth-order filter realized as the cascade of two second-order biquad sections. The reason for using a fourth order filter broken into two second order sections is that it allows the filter to retain numerical precision in the presence of finite word length effects, which can happen in both fixed and floating point implementations. An example implementation of such an embodiment may assume a form similar to the following:

Two memory locations are allocated, designated as d(k−1) and d(k−2), with each holding a quantity known as a state variable. For each input sample x(k), a quantity d(k) is calculated using the coefficients a1 and a2:

$$d(k)=x(k)-a1*d(k-1)-a2*d(k-2)$$

The output y(k) is then computed, based on coefficients b0, b1, and b2, according to:

$$y(k)=b0*d(k)+b1*d(k-1)+b2*d(k-2)$$

The above computation comprising five multiplies and four adds is appropriate for a single channel of second-order biquad section. Accordingly, because the fourth-order high pass filter is realized as a cascade of two second-order biquad sections, a single channel of fourth order input high pass filter would require ten multiples, four memory locations, and eight adds.

The high pass signal from the high pass filter is then filtered, as in 5020, with a first filter module to create a first filtered signal. The first filter module is configured to selectively boost or attenuate the gain of select frequency ranges within an audio signal, such as the high pass signal. Accordingly, the first filter module may comprise a second order low shelf filter and a second order high shelf filter in at least one embodiment. In at least one embodiment, the first filter module boosts the content above a first frequency by a certain amount, and attenuates the content below a first frequency by a certain amount, before presenting the signal to a compressor or dynamic range controller. This allows the dynamic range controller to trigger and adjust higher frequency material, whereas it is relatively insensitive to lower frequency material.

The first filtered signal from the first filter module is then modulated, as in 5030, with a first compressor. The first compressor may comprise an automatic or dynamic gain controller, or any circuits appropriate for the dynamic compression of an audio signal. Accordingly, the compressor may comprise standard dynamic range compression controls such as threshold, ratio, attack and release. An example implementation of the first compressor may assume a form similar to the following:

The compressor first computes an approximation of the signal level, where att represents attack time; rel represents release time; and invThr represents a precomputed threshold:

```
temp = abs(x(k))
if temp > level (k−1)
    level(k) = att * (level(k−1) − temp) + temp
else
    level = rel * (level(k−1) − temp) + temp
```

This level computation is done for each input sample. The ratio of the signal's level to invThr then determines the next step. If the ratio is less than one, the signal is passed through unaltered. If the ratio exceeds one, a table in the memory may provide a constant that's a function of both invThr and level:

```
if (level * thr < 1)
    output(k) = x(k)
else
    index = floor(level * invThr)
if (index > 99)
    index = 99
gainReduction = table[index]
output(k) = gainReduction * x(k)
```

The modulated signal from the first compressor is then filtered, as in 5040, with a second filter module to create a second filtered signal. The second filter module is configured to selectively boost or attenuate the gain of select frequency ranges within an audio signal, such as the modulated signal. Accordingly, the second filter module may comprise a second order low shelf filter and a second order high shelf filter in at least one embodiment. In at least one embodiment, the second filter module boosts the content above a second frequency by a certain amount, and attenuates the content below a second frequency by a certain amount. In at least one embodiment, the second filter module adjusts the content below the first specified frequency by a fixed amount, inverse to the amount that was removed by the first filter module. By way of example, if the first filter module boosted content above a first frequency by +X dB and attenuated content below a first frequency by −Y dB, the second filter module may then attenuate the content above the first frequency by −X dB, and boost the content below the first frequency by +Y dB. In other words, the purpose of the second filter module in one embodiment may be to "undo" the filtering that was applied by the first filter module.

The second filtered signal from the second filter module is then processed, as in 5050, with a first processing module to create a processed signal. The processing module may comprise a gain element configured to adjust the level of the signal. This adjustment, for instance, may be necessary because the peak-to-average ratio was modified by the first compressor. The processing module may comprise a peak/dip module. The peak/dip module may comprise ten cascaded second-order filters in at least one embodiment. The peak/dip module may be used to shape the desired output spectrum of the signal. In at least one embodiment, the first processing module comprises only the peak/dip module. In other embodiments, the first processing module comprises a gain element followed by a peak/dip module.

The processed signal from the first processing module is then split, as in 5060, with a band splitter into a low band signal, a mid band signal, and a high band signal. The band splitter may comprise any circuit or combination of circuits appropriate for splitting a signal into a plurality of signals of different frequency ranges. In at least one embodiment, the band splitter comprises a fourth-order band-splitting bank. In this embodiment, each of the low band, mid band, and high band are yielded as the output of a fourth-order section, realized as the cascade of second-order biquad filters.

The low band signal is modulated, as in 5070, with a low band compressor to create a modulated low band signal. The low band compressor may be configured and/or computationally identical to the first compressor in at least one embodiment. The high band signal is modulated, as in 5080, with a high band compressor to create a modulated high band signal. The high band compressor may be configured and/or computationally identical to the first compressor in at least one embodiment.

The modulated low band signal, mid band signal, and modulated high band signal are then processed, as in 5090, with a second processing module. The second processing module comprises at least a summing module. The summing module is configured to combine a plurality of signals into one composite signal. In at least one embodiment, the summing module may further comprise individual gain controls for each of the incoming signals, such as the modulated low band signal, the mid band signal, and the modulated high band signal. By way of example, an output of the summing module may be calculated by:

$$out=w0*low+w1*mid+w2*high$$

The coefficients w0, w1, and w2 represent different gain adjustments. The second processing module may further comprise a second gain element. The second gain element may be the same as the first gain element in at least one embodiment. The second gain element may provide a final gain adjustment. Finally, the second processed signal is transmitted as the output signal.

Figure 9:
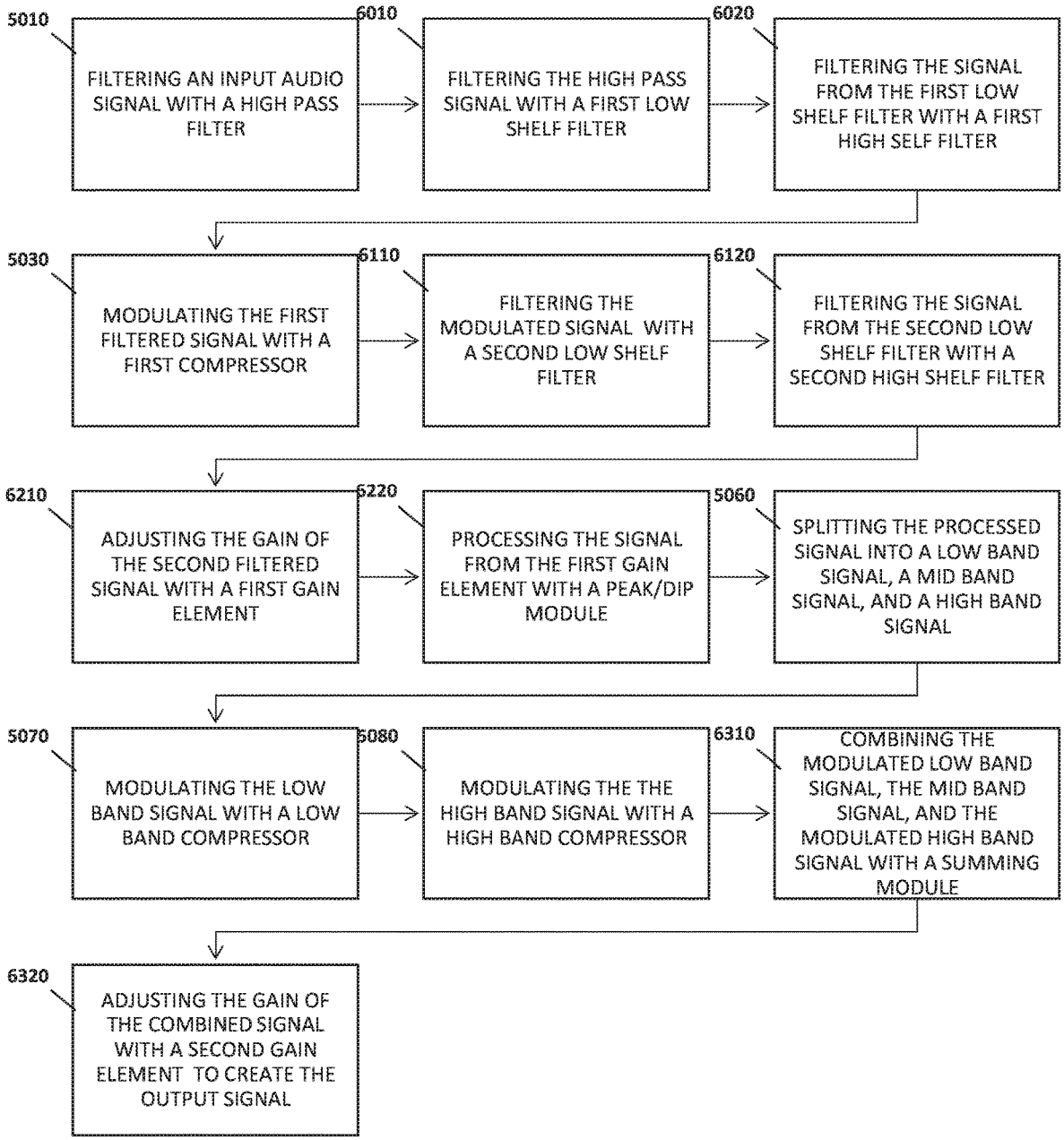
FIG. 9 illustrates a block diagram of another method for processing an audio signal with an audio processor according to another embodiment of the present invention.

As diagrammatically represented, FIG. 9 illustrates a block diagram of one method for processing an audio signal with an audio processor 220, which may in at least one embodiment incorporate the components or combinations thereof from the systems 1000 and/or 3000 referenced above. Because the individual components of FIG. 9 have been discussed in detail above, they will not be discussed here. Further, each step of the method in FIG. 9 as detailed below may also be in the form of a code segment directed to at least one embodiment of the present invention, which is stored on a non-transitory computer readable medium, for execution by the audio processor 220 of the present invention.

Accordingly, an input audio signal is first filtered, as in 5010, with a high pass filter. The high pass signal from the high pass filter is then filtered, as in 6010, with a first low shelf filter. The signal from the first low shelf filter is then filtered with a first high shelf filter, as in 6020. The first filtered signal from the first low shelf filter is then modulated with a first compressor, as in 5030. The modulated signal from the first compressor is filtered with a second low shelf filter as in 6110. The signal from the low shelf filter is then filtered with a second high shelf filter, as in 6120. The second filtered signal from the second low shelf filter is then gain-adjusted with a first gain element, as in 6210. The signal from the first gain element is further processed with a peak/dip module, as in 6220. The processed signal from the peak/dip module is then split into a low band signal, a mid band signal, and a high band signal, as in 5060. The low band signal is modulated with a low band compressor, as in 5070. The high band signal is modulated with a high band compressor, as in 5080. The modulated low band signal, mid band signal, and modulated high band signal are then combined with a summing module, as in 6310. The combined signal is then gain adjusted with a second gain element in order to create the output signal, as in 6320.

Figure 10:
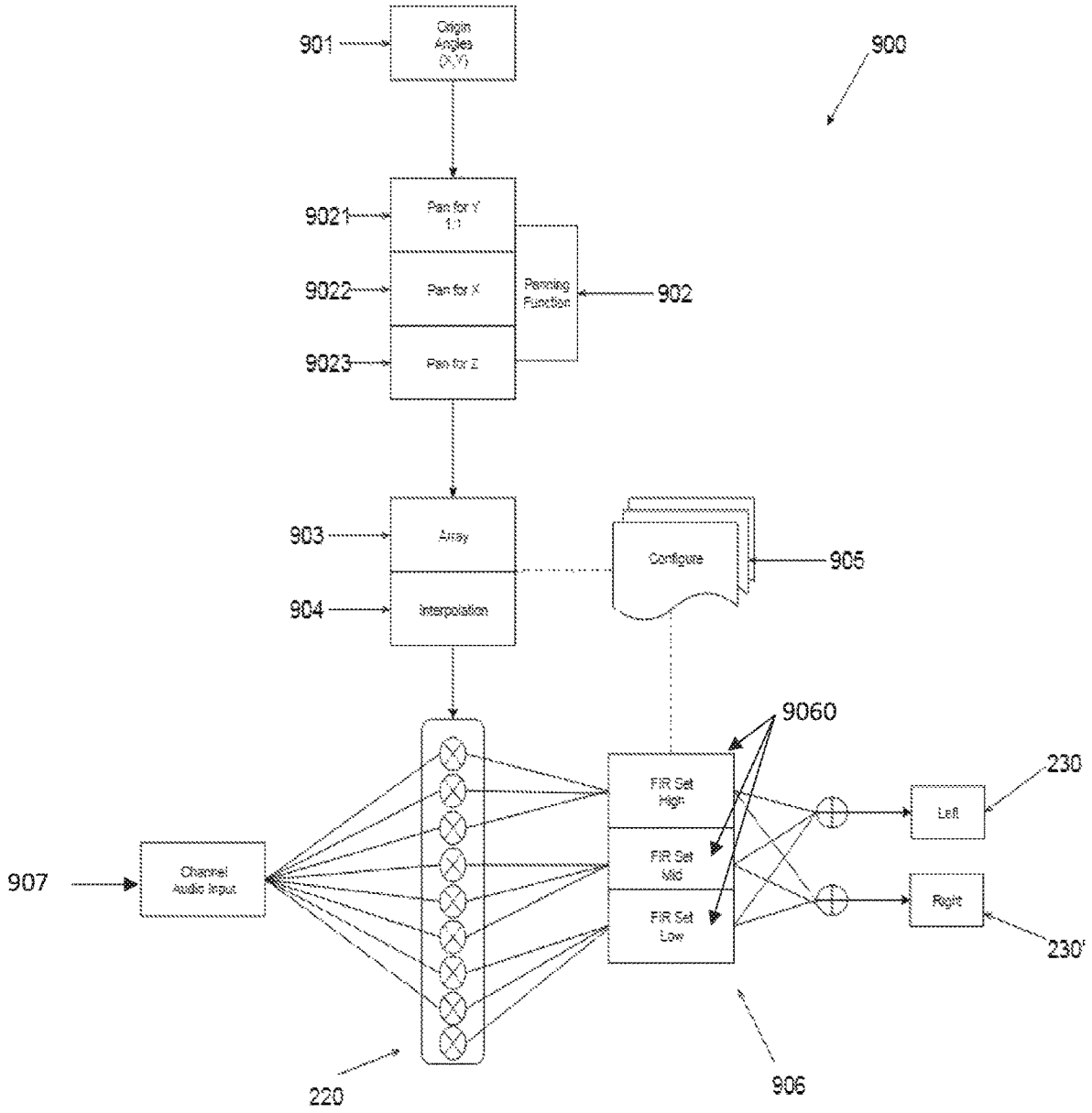
FIG. 10 illustrates a block diagram of one method of processing an audio signal from a single channel while the user is panning.

With reference to FIG. 10, it is envisioned that a large variety of audio filter systems 900 comprising signal filters and audio processors 220 may be used for generating and/or panning a head related audio transfer function for a user. By way of non-limiting example, in one additional embodiment, a system comprising at least an FIR filter bank 906 further comprising a plurality of FIR filter pair 9060*s* may be arranged and dimensioned to surround at least a portion of a user's head, such as via left and right headphones or speakers. Additionally, each FIR filter pair 9060 in the system may include two individual FIR filters arranged in, at least but not limited to, ideally a "mid/side" configuration so as to facilitate conversion of a sound input to sound output while maintaining directionality. In at least one additional embodiment, the plurality of FIR filter pair 9060*s* are arranged into two hemispheres each configured to surround at least a portion of a user's head to create a virtual speaker sphere. Each FIR filter pair 9060 may be configured to have two input channels, one channel each for the right and left side. Each specific FIR filter pair 9060 may additionally be associated with a specific playback module 230 or speaker of a of playback modules that are equivalently arranged and dimensioned to surround at least a portion of a user's head. Upon receiving a sound signal input through a channel audio input 907, containing information corresponding to the desired virtual location or directionality of the signal therein, the signal processor 220 or upmixer may then determine an origin angle 901 based on the information in the signal for each channel audio input 907. It is envisioned that each input's origin angle 901 determines its original point on the virtual speaker sphere. The origin angle 901 consists of at least an angle of input (X/Y). Additionally, once the origin angle 901 is known, an output 905 may be determined for a given playback module 230 through checking an angle to level relationship that may be stored in an array 903, empirically derived formula, or interpolation 904.

It is envisioned that users may be in motion or in different positions while the system or method determines an origin angle 901. For instance, if a user hears a sound within a virtual environment with a directionality indicating the source of the sound is or should be behind the user, and the user turns right while the sound continues to play, the user must have the outputs adjusted accordingly. As such, in at least one embodiment, the system or method of HRTF may be additionally configured to incorporate a panning function 902, wherein the system or method 900 may account for motion of a user's head in all axes X, Y, and Z. The panning function 902 is configured to translate the origin angles 901 of each input into new angles based on a user's panning input. The panning input may also be a head tracking system or panning controls using principal axes. By way of non-limiting example, the X-axis may refer to the transverse axis "pitch," or any vertical rotation of a user's head typically exemplified by a nodding motion. The Y-axis may refer to the vertical axis "yaw," or any side-to-side rotation of a user's head typically exemplified by shaking a user's head to say no. The Z-axis may refer to the longitudinal axis "roll," or any head-rolling motion exemplified by pointing an ear on the user's head downward while pointing the opposite ear upward. Accordingly, the system or method will also include at least, but may be not limited to, a gyroscope, accelerometer, and/or magnetometer, as well as any software or program to interpret any data produced therefrom.

Accordingly, in at least one additional embodiment, any panning in Y 9021, panning in X, 9022, or panning in Z 9023 will correspondingly modify the calculation of the output by changing the origin angle 901 to reflect such panning. By way of non-limiting example, various panning logic rules as part of the panning function 902 may be implemented to automatically account for any change of axes such that the origin angle 901 must be modified. An example of the base panning logic may include beginning with calculation of the Y-axis angle by assuming a form similar to (Y-axis origin−Y-axis panning). When the Y-axis angle is at its starting point, defined as 0 degrees, X-axis panning and Z-axis panning are calculated as normal, without either the X or Z axes modifying each other therein. When the Y-axis angle pans to 90 degrees, defined as turning left, the X-axis panning is modified to 0%, and the Z-axis panning modifies X-panning to 100%. When the Y-axis angle pans to 180 degrees, which faces opposite to the aforementioned 0-degrees starting point, X-axis panning becomes its opposite with −100% in relation to the starting point. By way of demonstrative example, when at an initial starting point of Y-axis angle 0 degrees, a 10 degree change in the X-axis is the equivalent to a −10 degree change in the X-axis when the Y-axis angle is set at 180 degrees. Additionally, when the Y-axis angle pans to 270 degrees, X-axis panning is modified to 0% and Z-axis panning modifies X-panning to −100%. In this specific ruleset, the X-axis need only be concerned with angles from 0-90 degrees and from 0-270 degrees, since the remaining angles from 90-270 degrees are handled by changes in the Y-axis.

Figure 11:
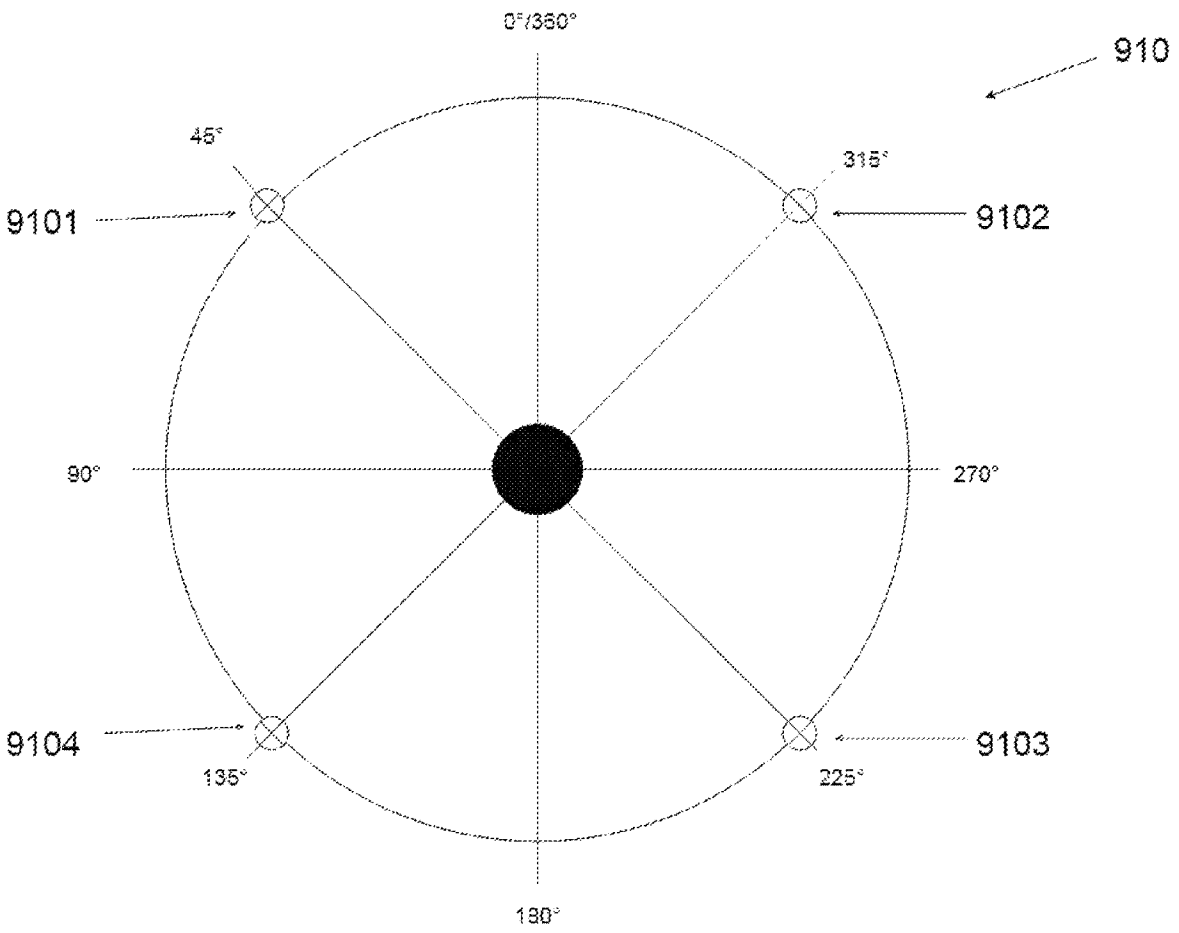
FIG. 11 illustrates a schematic of initial angles of arbitrary calculation points of a bird's eye view of a user's head.
Figure 12:
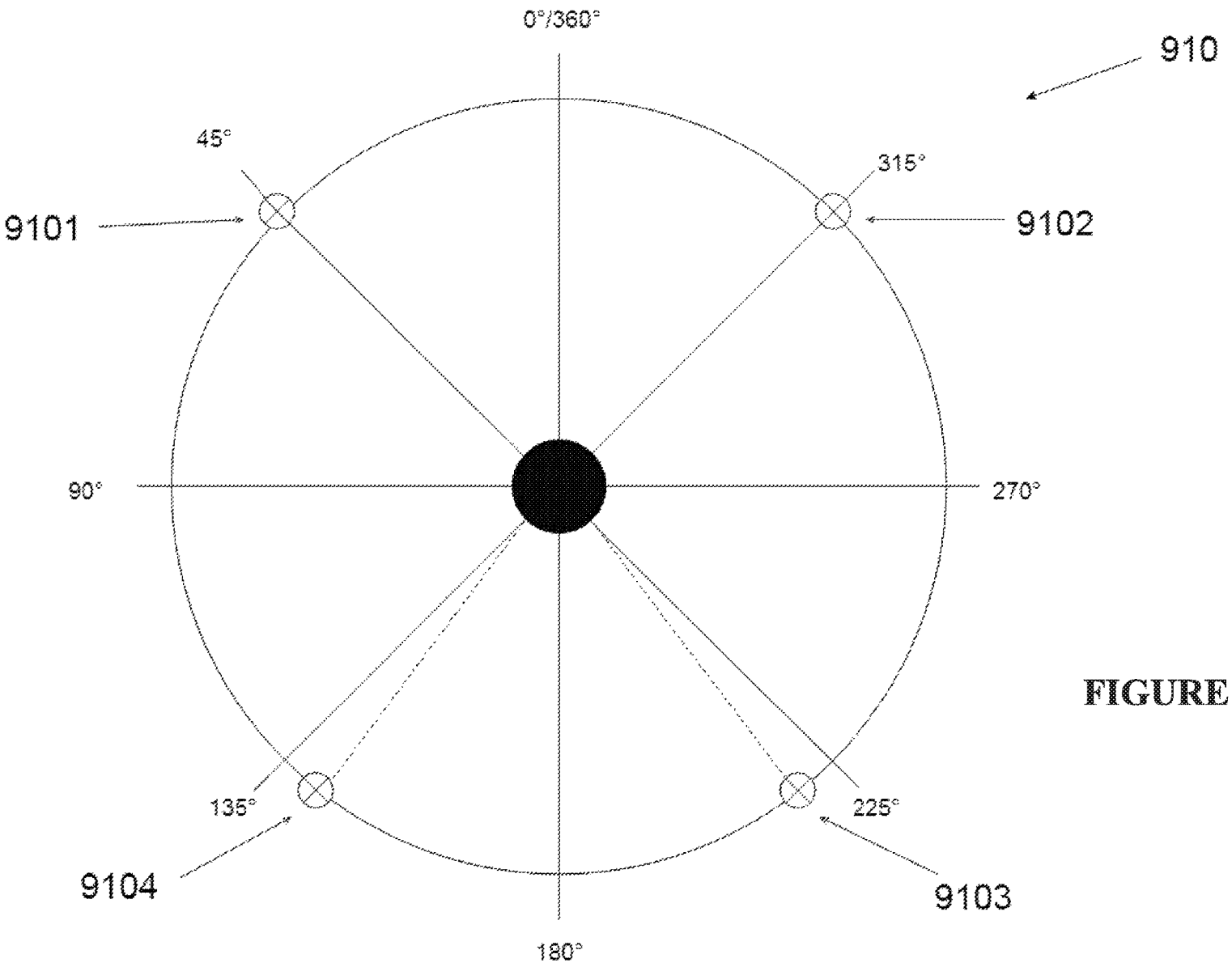
FIG. 12 illustrates a schematic of adjusted angles of arbitrary calculation points of a bird's eye view of a user's head after panning.

By way of non-limiting example, and with reference to FIGS. 11 and 12, the angles may be described with any number of arbitrary points from a bird's eye view of the user's head or X-axis. Multiple sources may be initially set with original angles for each channel, and subsequently be passed through an array or "lookup table" and be offset by a panning function's 902 angle value. For instance, with reference to FIG. 11, it can be observed that the system may set four arbitrary points Front Left (FL) 9101, Front Right (FR) 9102, Rear Left (RL) 9104, and Rear Right (RR) 9104 with angle coordinates in the format (Y, X, Z) on a bird's-eye view of the X-axis, the initial origin angles of the four arbitrary points may be listed as:

FL 9101=(45, 0, 0)
FR 9102=(315, 0, 0)
RL 9104=(145, 0, 0)
RR 9103=(215, 0, 0)

Turning to FIG. 12, modifying the initial origin angle 901 by rotating the user 5 degrees to the left and 10 degrees up changes the initial origin angle 901 into:

FL 9101=(40, 10, 0)
FR 9102=(310, 10, 0)
RL 9104=(140, 190, 0)
RR 9103=(210, 190, 0)

It is envisioned that any form of such panning logic may be used as the panning function 902, such as initially calculating the X-axis panning 9022 and using Y-axis panning 9021 to modify the Z-axis panning 9023. However, because rotation about the Y-axis is usually the most common movement of a user's head, the preferred embodiment will initially calculate the Y-axis angle and modify the X-axis and Z-axis accordingly. In yet another embodiment, pre-made or commercial software may be used to as the panning function 902 for modifications to origin angle 901. It is additionally envisioned that users will desire subjective calibration, flexibility, and management of the outputs. Accordingly, any aforementioned rules or logic may be changed or modified to reflect user preference.

In at least one embodiment, arrays 903 may be used to translate a sound input signal passed through an audio processor 220, specifically but not limited to an upmixer, into an origin angle 901, and subsequently into an output, specifically but not limited to a decibel value for a corresponding individual left 230 and right 230' playback module or speaker 230. The array 903 may include but is not limited to a Y angle index corresponding to every X angle. Accordingly, the array 903 may contain every X/Y combination of angles within the desired points on the combination of two symmetric hemispheres and may be modified accordingly to increase precision in relation to the number of output points on the system or method. Further, each X/Y combination may correspond with a decibel output. In at least one embodiment, the array 903 may be used as a reference for any number of input channels 907 where each channel has an origin angle 901 that is unique. By way of non-limiting example, each X/Y combination corresponding to a decibel value may have a default minimum value of −80 dB with reference to the original signal. It is envisioned that this minimum value may be changed with an allowable range of −20 dB to −100 dB for personalized testing. Additionally, in at least one additional embodiment, the minimum dB value represents a mute level and is essential for interpolation 904 calculation.

In another embodiment, the arrays 903 may be modified in any way, including but not limited to modification of the outputs 905 based on combinations of X/Y, or the addition or subtraction of X/Y combinations to yield a more precise table. Accordingly, in at least one additional embodiment, the values in the array may be empirically created and modified by careful subjective calibration based on the perceived location of the audio source. This approach serves to decouple the discrete speaker locations from the perceived result of mixing signals between pairs of filters.

If the origin angle of an input channel is known, the position relative to the origin can be interpolated by looking up closest values in the array. It is thus additionally envisioned that the system or method of generating HRTF may not produce the input calculations in the exact quantities listed in an array. Accordingly, in an additional embodiment of the present invention, the system or method may use interpolation to either find the nearest possible values or a calculation of an empirically derived relationship. By way of non-limiting example, upon receiving an input that does not perfectly align with the quantities listed in the array, software in the system or method may select the closest two rows for X and the closest two rows for Y for use in linear interpolation to output a decibel value. Specifically, in at least one embodiment for Y and X-Axis location and interpolation after panning, given a desired location for the sound to come from, determined by modifying the current angle of the head, the system or method may look up the closest entries in the array or lookup table to (1) find the Y angle index that is larger than the Y target with smaller X, (2) find the Y angle index that is smaller than the Y target with smaller X, (3) find the Y angle index that is larger than the Y target with larger X, (4) find the Y angle index that is smaller than the Y target with larger X. Upon locating the aforementioned four rows, the system or method may then calculate a Y-ratio modifier and X-ratio modifier which may assume a form similar to the following:

$$\text{mod } y=(\text{small}Y\text{TableAngle}-\text{current}Y\text{Angle})/(\text{large}Y\text{TableAngle}-\text{current}Y\text{Angle})$$

mod $x$=(small$X$TableAngle−current$X$Angle)/(large$X$-TableAngle−current$X$Angle)

whereupon the system or method may then loop through the 4 rows selected rows to calculate a new Y to small X array and Y to large X array. Subsequently, using any pre-determined or empirical formula allows for interpolation of the final output level array. A gain table may be used to translate the final coordinate angles to the volume level of the correct speaker.

FIG. 13 is an exemplary array table comprising origin angles 901 and a plurality of corresponding decibel levels 9032 with respect to a particular speaker location 9031 within the virtual sphere of speakers. An example of an array 903 of the present invention can be observed in FIG. 13. Upon receiving an input signal containing information on an origin angle 901 comprising of a Y-Axis degree and X-Axis degree, a processor may accordingly associate an output, at least ideally but not limited to a decibel level, to a plurality of speakers. By way of non-limiting example, with reference to FIG. 13, an origin angle with 0 degrees in both the Y-Axis and X-Axis may result in attenuating the following speakers: 0 decibel attenuation to the Center speaker (center mid), −10 decibel output to a Front Left (FL mid) speaker, −80 decibel output to Side Left (SL mid) speaker, −80 decibel output to Side Right (SR mid) speaker, −80 decibel output to a Back Left (BL mid) speaker, −80 decibel output to a Back Right (BR mid) speaker. It is envisioned that any value in the array table may be modified, at least but not limited to dimension, decibel or output values, origin angles, or minimums for personal preference. Additionally, any number of array tables may be used to increase or decrease the precision of an origin angle as related to a speaker output. For instance, additional array tables 903 may be constructed for speakers located on the bottom or top of any system in addition to array tables 903 covering the middle speakers 9031. Additionally, interpolation may be used to find the appropriate attenuation for degrees not listed in a table.

It should be understood that the above steps may be conducted exclusively or nonexclusively and in any order. Further, the physical devices recited in the methods may comprise any apparatus and/or systems described within this document or known to those skilled in the art.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A system of generating an adjusted head related audio transfer function (HRTF) for a user, the system comprising:

at least one channel audio input configured to receive an input signal therein, the input signal containing information corresponding to at least an origin angle to be perceived by the user, a motion translator configured to track motion of the user about at least three axes, an X-axis transverse to the user's head, a Y-axis pointing vertically up from the user's head, and a Z-axis pointing longitudinally away from a user's face, a panning function configured to translate said origin angle of said input signal into an adjusted origin angle configured in response to motion of the user, said panning function configured to first determine an angle of rotation about said Y-Axis, and upon determining said angle of rotation about said Y-axis, determining an angle of rotation about said X-axis, and modifying said angle of rotation about said X-axis based on at least said angle of rotation about said Y-axis, an array configured to associate said adjusted origin angle to a predetermined decibel value, an interpolation function configured to calculate the predetermined decibel value upon detecting an absence of said adjusted origin angle in the array, a processor configured to convert said predetermined decibel value into an output signal containing information on positional audio data, a plurality of FIR filters configured to filter said output signal to create a filtered signal, a plurality of speakers configured to relay positional audio data to the user.

2. The system of claim 1 wherein the positional audio data comprises said predetermined decibel value of said output signal with respect to the input signal.

* * * * *